US006458499B1

(12) United States Patent
Onuma et al.

(10) Patent No.: US 6,458,499 B1
(45) Date of Patent: Oct. 1, 2002

(54) TONER HAVING HYDROCARBON WAX WITH SPECIFIC ESTER VALUE AND HYDROXYL VALUE

(75) Inventors: Tsutomu Onuma, Yokohama; Hirohide Tanikawa, Shizuoka-ken; Nobuyuki Okubo, Yokohama; Tsuneo Nakanishi, Abiko; Katsuhisa Yamazaki, Numazu; Kaori Hiratsuka, Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/870,661

(22) Filed: Jun. 1, 2001

(30) Foreign Application Priority Data

Jun. 2, 2000 (JP) ..... 2000-165362

(51) Int. Cl.[7] ..... G03G 9/087

(52) U.S. Cl. ..... 430/108.4; 430/108.8; 430/109.1; 430/111.4

(58) Field of Search ..... 430/108.4, 108.8, 430/111.4, 69.1

(56) References Cited

U.S. PATENT DOCUMENTS

| | | | | |
|---|---|---|---|---|
| 2,297,691 | A | | 10/1942 | Carlson |
| 3,666,363 | A | | 5/1972 | Tanaka et al. ..... 355/17 |
| 4,071,361 | A | | 1/1978 | Marushima |
| 4,859,550 | A | | 8/1989 | Gruber et al. ..... 430/39 |
| 4,883,736 | A | | 11/1989 | Hoffend et al. ..... 430/110 |
| 4,921,771 | A | | 5/1990 | Tomono et al. ..... 430/110 |
| 5,753,397 | A | | 5/1998 | Nakayama ..... 430/110 |
| 5,840,459 | A | | 11/1998 | Ohno et al. ..... 430/110 |
| 5,851,718 | A | * | 12/1998 | Ohwada et al. ..... 430/124 |
| 5,858,598 | A | | 1/1999 | Nakayama ..... 430/110 |
| 6,090,515 | A | * | 7/2000 | Tomiyama et al. ..... 430/108.4 |
| 6,203,959 | B1 | | 3/2001 | Tanikawa et al. ..... 430/110 |
| 2001/0026899 | A1 | * | 10/2001 | Uchida et al. ..... 430/108.4 |

FOREIGN PATENT DOCUMENTS

| | | |
|---|---|---|
| EP | 899617 | 3/1999 |
| EP | 922714 | 6/1999 |
| JP | 52-3304 | 1/1977 |
| JP | 52-3305 | 1/1977 |
| JP | 57-52574 | 11/1982 |
| JP | 63-113558 | 5/1988 |
| JP | 63-188158 | 8/1988 |
| JP | 1-109359 | 4/1989 |
| JP | 2-134648 | 5/1990 |
| JP | 4-097162 | 3/1992 |
| JP | 4-097163 | 3/1992 |
| JP | 4-184350 | 7/1992 |
| JP | 4-194946 | 7/1992 |
| JP | 4-194947 | 7/1992 |
| JP | 4-194948 | 7/1992 |

* cited by examiner

*Primary Examiner*—Christopher Rodee
(74) *Attorney, Agent, or Firm*—Fitzpatrick, Cella, Harper & Scinto

(57) ABSTRACT

A toner is principally constituted by a binder resin, a colorant and a hydrocarbon wax. The hydrocarbon wax has a hydroxyl value (Hv) of 5–150 mgKOH/g and an ester value (Ev) of 1–50 mgKOH/g satisfying Hv>Ev. Further, the toner has a tetrahydrofuran-soluble content providing a gel-permeation chromatogram showing at least one peak in a molecular weight region of $3\times10^3$ to $5\times10^4$ and at least one peak or shoulder in a molecular weight region of $1\times10^5$ to $1\times10^7$.

33 Claims, No Drawings

TONER HAVING HYDROCARBON WAX WITH SPECIFIC ESTER VALUE AND HYDROXYL VALUE

FIELD OF THE INVENTION AND RELATED ART

The present invention relates to a toner used for developing electrostatic images in an image forming method, such as electrophotography or electrostatic recording, or for use in an image forming method according to the toner jetting scheme.

Hitherto, a large number of electrophotographic processes have been known, as disclosed in, e.g., U.S. Pat. Nos. 2,297,691, 3,666,363 and 4,071,361. In these processes, an electrostatic image is formed on a photosensitive member comprising generally a photoconductive material by various means, then the electrostatic image is developed with a toner, and the resultant toner image is, after being transferred onto a transfer (-receiving) material such as paper, fixed by heating, pressing, or heating and pressing, to obtain a copy or a print. A transfer residual toner remaining on the photosensitive member after the transfer step is cleaned by various means, and the above-mentioned steps are repeated for a subsequent image forming cycle.

An image forming apparatus used for such an electrophotographic process has recently been started to be used not only as a copying machine for office for simply duplicating an original but also as a printer as a computer output equipment or in a field of personal copy.

For this reason, the image forming apparatus has been constituted by simpler structural members in order to realize a small size, a light weight, a high speed and a high reliability required therefor. As a result, a toner used in the image forming apparatus is also required to exhibit higher performances. Accordingly, if an improvement in toner performances is not achieved, an image forming apparatus using the toner is liable to fail to exhibit higher performances.

For example, various methods and apparatus as to a step of fixing a toner image onto a sheet such as paper have been developed. Specifically, a heating and pressing fixation system using hot rollers and a heating fixation system wherein a toner (image) is caused to closely contact a heating member via a film by using a pressing member have been proposed.

According to such heating fixation systems, the fixation is performed by passing a toner image-carrying surface of a sheet to be fixed (fixation sheet) while causing the toner image-carrying surface of fixation sheet to contact a surface of hot rollers or film composed of a material having a releasability with the toner. In these systems, the surface of hot rollers or film and the toner image carried on the fixation sheet contact each other, so that a very good heat efficiency is attained when the toner image, thus allowing quick fixation particularly in an electrophotographic copying machine or a printer.

In the above systems, however, a hot roller or film surface and a toner image contact each other in a melted state of the toner, so that a part of the toner is transferred and attached to the fixing roller or film surface and then re-transferred to a subsequent fixation sheet to cause an offset phenomenon, thus being liable to soil the fixation sheet. Accordingly, it is important in the above-mentioned heating fixation systems that the toner is controlled so as not to attach the hot fixing roller or film surface.

In order to prevent a toner from sticking onto a fixing roller surface, it has been conventionally practiced to compose the fixing roller surface of a material showing excellent releasability against the toner (e.g., silicone rubber or fluorine-containing resin) and further coat the surface with a film of a liquid showing a good releasability, such as silicone oil, so as to prevent the offset and deterioration of the fixing roller surface. This method is very effective for preventing offset but requires a device for supplying such an offset preventing liquid, thus resulting in complication of a fixing apparatus.

Further, this is contrary to the demand for a smaller and lighter apparatus and can sometimes soil the inside of the apparatus due to vaporization of the silicone oil, etc., by application of heat. Therefore, based on a concept of supplying an offset-preventing liquid from the inside of toner particles under heating instead of using a device of supplying silicone oil, there has been proposed to incorporate a release agent, such as low-molecular weight polyethylene or low-molecular weight polypropylene, into toner particles. However, addition of such a release agent in an amount exhibiting a sufficient effect is liable to lead to (toner) image deterioration due to filming onto a photosensitive member or soiling of the surface of a carrier or a toner-carrying member, such as a developing sleeve. Accordingly, there has been adopted a combination of adding a release agent in an amount small enough not to cause image deterioration into toner particles and supplying a small amount of a release oil or using a cleaning device including a web used little by little to be would up for removing offset toner. However, in view of recent demands for a smaller size, lighter weight and higher reliability, it is necessary and preferred to omit such additional devices. Accordingly, a toner is required to be further improved i performances such as fixability and anti-offset characteristic, so that a binder resin and a release agent for use in a toner are desired to be further enhanced in their properties.

The addition of waxes as a release agent in toner particles has been known, as disclosed in, e.g., Japanese Patent Publication (JP-B) 52-3304, JP-B 52-3305, and JP-B 57-52574.

These waxes have been used to provide a toner improved in anti-offset characteristic at low or high temperature. However, the addition of these waxes have led to adverse effects, such as lowering in anti-blocking property and lowering in developing performance of the toner in some cases.

Further, incorporation of an alcohol component into toner particles has been proposed in Japanese Laid-Open Applications (JP-A) 63-113558, 63-188158, H2-134648, H4-97162 and H4-97163. The alcohol component is effective in improving a low-temperature fixability and a high-temperature anti-offset characteristic of toner but lowers a developing characteristic of toner in some cases.

JP-A Hl-109359 has proposed incorporation of a low-molecular weight polyolefin polyol wax into toner particles. Such an incorporation of the wax effectively improves toner fixability and developing characteristic. However, in this case, the resultant toner exhibits poor anti-blocking characteristic and high-temperature anti-offset characteristic in some cases.

Further, incorporation of a partially esterified product of polyglycerin has been proposed in JP-A H4-184350, JP-A H4-194946, JP-A H4-194947 and JP-A H4-194948. Even when such a polyglycerin compound is added in a toner, sufficient fixability and anti-offset characteristic have not bee satisfied as yet.

SUMMARY OF THE INVENTION

Accordingly, a generic object of the present invention is to provide a toner having solved the above-mentioned problems.

A more specific object of the present invention is to provide a toner capable of exhibiting good fixing performances including improved low-temperature fixability and anti-offset characteristic.

Another object of the present invention is to provide a toner capable of suppressing an occurrence of toner attachment onto a fixing member even in a long-term of use and providing excellent image characteristics similarly as in the initial stage.

Another object of the present invention is to provide a toner comprising toner particles in which a wax is uniformly dispersed, and thus being capable of providing excellent images-as in the initial image.

Another object of the present invention is to provide a toner capable of exhibiting excellent low-temperature fixability and continuous image forming characteristic even at a high process speed.

A further object of the present invention is to provide a toner excellent in long-term storability.

According to the present invention, there is provided a toner, comprising at least a binder resin, a colorant and a hydrocarbon wax, wherein the hydrocarbon wax has a hydroxyl value (Hv) of 5–150 mgKOH/g and an ester value (Ev) of 1–50 mgKOH/g satisfying Hv>Ev, and the toner has a tetrahydrofuran-soluble content providing a gel-permeation chromatogram showing at least one peak in a molecular weight region of $3\times10^3$ to $5\times10^4$ and at least one peak or shoulder in a molecular weight region of $1\times10^5$ to $1\times10^7$.

These and other objects, features and advantages of the present invention will become more apparent upon a consideration of the following description of the preferred embodiments of the present invention.

DETAILED DESCRIPTION OF THE INVENTION

As a result of our study, it has been found possible to provide a toner that shows a good developing fixability in a wide temperature range from low temperature to high temperature and shows an excellent developing characteristic over a wide variety of environment inclusive of high temperature/high humidity environment and low temperature/low humidity environment, by incorporating into toner particles of a hydrocarbon wax having a hydroxyl value (Hv) of 5–150 mgKOH/g (preferably 10–100 mgKOH/g, more preferably 20–90 mgKOH/g) and an ester value (Ev) of 1–50 mgKOH/g (preferably 1–30 mgKOH/g, more preferably 1–20 mgKOH/g, particularly preferably 1–15 mgKOH/g) satisfying Hv>Ev, and providing the toner with a tetrahydrofuran (THF)-soluble content having such a molecular weight distribution as to provide a gel-permeation chromatogram (GPC chromatogram), obtained by GPC (gel-permeation chromatography), showing at least one peak in a molecular weight region of $3\times10^3$ to $5\times10^4$ and at least one peak or shoulder in a molecular weight region of $1\times10^5$ to $1\times10^7$ .

The hydrocarbon wax used in the present invention may preferably have a hydrocarbon molecular chain having a chemical structure described below.

Such a hydrocarbon wax may comprise wax molecules each having a molecular chain including a secondary alcohol structure (having a hydroxyl group connected to secondary carbon atom) represented by a partial structural formula (A) shown below and having a molecular chain including an ester structure (having an ester bond) represented by a partial structural formula (B) shown below. In this case, the secondary alcohol structure (formula (A)) and the ester structure (formula (B)) may be contained together in one hydrocarbon molecular chain. Further, it is also preferred that each wax molecule has a hydrocarbon molecular chain including an acid structure (having a carboxyl group connected to primary or secondary carbon atom) represented by partial structural formulas (C) and (D) shown below. A hydrocarbon molecular chain of the hydrocarbon wax may have a primary alcohol structure (having a hydroxyl group connected to primary carbon atom) represented by a partial structural formula (E) shown below. In the hydrocarbon wax used in the present invention, one hydrocarbon molecularly chain constituting each wax molecule may have any one of or any combination of two or more species of the following partial structural formula (A), (B), (C), (D) and (E).

(A)

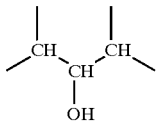

(B)

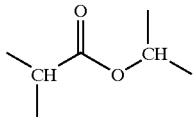

(C)

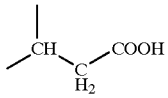

(D)

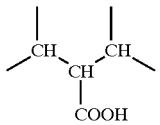

(E)

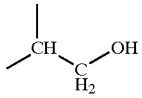

The hydrocarbon wax used in the toner according to the present invention hag an hydroxyl group in an appropriate amount (Hv=5–150 mgKOH/g) in wax molecules, so that the hydrocarbon wax is dispersed in a binder resin in a particulate form to exhibit an appropriate plasticizing effect, thus improving a fixability. Further, the dispersed hydrocarbon wax in particulate form is liable to quickly nigrate to a toner particles surfaces, thus having an anti-offset characteristic of the toner. If the hydrocarbon wax (Hv) of the hydrocarbon wax is below 5 mgKOH/g, the hydrocarbon wax is not sufficiently dispersed finely in a binder resin to lower a fixability and anti-offset characteristic of the toner. Above 150 mgKOH/g, the resultant plasticing effect of the hydrocarbon wax becomes too large, the toner is lowered in anti-offset characteristic.

The ester group in the hydrocarbon wax shows a high affinity with a binder resin component of the toner, thus allowing a presence of the hydrocarbon wax uniformly over toner particles to effectively exhibit the function of the hydrocarbon wax. If the ester value (Ev) of the hydrocarbon wax is below 1 mgKOH/g, a resultant effect of the hydrocarbon wax regarding a toner fixability and anti-offset characteristic is lowered. Above 50 mgKOH/g, the affinity of the hydrocarbon wax with a binder resin becomes too high, thus lowering a release function of the hydrocarbon wax. As a result, a sufficient anti-offset characteristic is not readily attained.

The toner contains a THF-soluble component having such a molecular weight distribution as to provide a GPC chromatogram showing at least one peak, preferably as a maximum peak, in a molecular weight region of $3\times10^3$ to $5\times10^4$, preferably $3\times10^3$ to $3\times10^4$, more preferably $5\times10^3$ to $2\times10^4$, in order to provide a good fixability. If the peak is in a molecular weight region of below $3\times10^3$, the anti-blocking characteristic is lowered. Above $5\times10^4$, a good fixability is not readily obtained. Further, it shows at least one peak or shoulder in a molecular weight region of $1\times10^5$ to $1\times10^7$, preferably $1\times10^5$ to $5\times10^6$, in order to provide a good anti-offset characteristic. If the peak or shoulder is in a molecular weight region of above $1\times10^7$, a resultant elasticity becomes large to lower a fixability.

Herein, "a peak in a molecular weight region of $3\times10^3$ to $5\times10^4$ or of $1\times10^5$ to $1\times10^7$" means that a peaktop is in the molecular weight region on the GPC chromatogram, and "a shoulder in a molecular weight region of $1\times10^5$ to $1\times10^7$" means that the GPC chromatogram shows an inflection point, i.e.; a point giving a maximum of the differential of the curve, in the molecular weight region.

The hydrocarbon wax used in the present invention has an ester group showing a high affinity with a binder resin component and also has a hydroxyl group, thus readily plasticizing the resultant toner. Particularly, the hydrocarbon wax effectively plasticizing a binder resin component in a low-molecular weight region of $3\times10^3$ to $5\times10^4$, thus providing the toner with a good fixability. Further, the toner of the present invention also contains a binder resin component in a high-molecular weight region of $1\times10^5$ to $1\times10^7$ and contains the hydrocarbon wax having the hydroxyl group exhibiting a high slippability. As a result, based on a synergistic effect of an elasticity of the high-molecular weight component and the slippability of the hydrocarbon wax, it is possible to effectively enhance a releasability of the toner (particles) from a fixing member and also further improve the anti-offset characteristic of the toner. In the present invention the high-molecular weight component (in the molecular weight of $1\times10^5$ to $1\times10^7$) is moderately plasticized by the hydrocarbon wax having ester group, thus improving a mutual solubility with the low-molecular weight component (in the molecular weight region $3\times10^3$ to $5\times10^4$). Further, as described above, the hydrocarbon wax also has the hydroxyl group to provide the toner surface with an appropriate degree of slippability, thus enhancing a triboelectric chargeability of the toner. As a result, a charging characteristic of the toner is uniformized and stabilized to provide a high image sensitive over a long-term use even in a severe environmental condition such as a high-temperature/high-humidity environment or a low-temperature/low-humidity environment while retaining a good developing performance with less occurrence of fog.

The molecular weight distribution of tetrahydrofuran (THF)-soluble contents of toners or binder resins described herein are based on GPC measurement performed according to the following manner.

<Molecular weight distribution measurement by GPC>

In a GPC apparatus, a column is stabilized in a heat chamber at 40° C., tetrahydrofuran (THF) solvent is caused to flow through the column at that temperature at a rate of 1 ml/min., and about 100 $\mu$l of a GPC sample solution is injected. The identification of sample molecular weight and its molecular weight distribution is performed based on a calibration curve obtained by using several monodisperse polystyrene samples and having a logarithmic scale of molecular weight versus count number.

The standard polystyrene samples for preparation of a calibration curve may be those having molecular weights in the range of about $10^2$ to $10^7$ available from, e.g., Toso K.K. or Showa Denko K.K. It is appropriate to use at least 10 standard polystyrene samples. The detector may be an RI (refractive index) detector. It is appropriate to constitute the column as a combination of a plurality of commercially available polystyrene gel columns. A preferred example thereof may be a combination of Shodex KF-801, 802, 803, 804, 805, 806, 807 and 800P, available from Showa Denko K.K., or a combination of TSK gel G1000H ($H_{XL}$), G2000H ($H_{LX}$), G3000H ($H_{LX}$), G4000H ($H_{LX}$), G5000H ($H_{LX}$), G6000H ($H_{LX}$), G7000H ($H_{LX}$) and TSK guard column.

The GPC sample may be prepared as follows.

A toner or binder resin sample is placed in THF and left standing for several hours. Then, the mixture is sufficiently shaken until a lump of the resinous sample disappears and then further left standing for more than 12 hours at room temperature. In this instance, a total time of from the mixing of the sample with THF to the completion of the standing in THF is taken for at least 24 hours. Thereafter, the mixture is caused to pass through a sample treating filter having a pore size of 0.45–0.5 $\mu$m (e.g., "Maishoridisk H-25-5", available from Toso K.K. or "Ekikurodisk 25CR", available from German Science Japan Co.) to recover the filtrate as a GPC sample. The sample concentration is adjusted to provide a resin concentration of 0.5–5 $\mu$mg/ml.

The hydrocarbon wax may preferably have an acid value (Av) of 1–30 mgKOH/g, more preferably 1–15 mgKOH/g, further preferably 1–10 mgKOH/g. By incorporating an acid group into the hydrocarbon wax, the hydrocarbon wax has a larger boundary adhesive force with other components constituting the toner of the present invention, thus being improved in plasticizing effect to the toner to enhance the fixability of the toner. If the acid value (Av) is below 1 mgKOH/g, the boundary adhesive force of the hydrocarbon wax with other toner components is decreased, thus being liable to cause liberation of wax to result in poor function of the hydrocarbon wax in some cases. Above 30 mgKOH/g, the boundary adhesive force becomes too large, plasticization of the toner is accelerated excessively, thus failing to retain a sufficient releasability in some cases.

The hydrocarbon wax used in the present invention appropriately has the hydroxyl value (Hv) and the ester value (Ev) while satisfying the following relationship:

Hv>Ev, preferably Hv>2×Ev.

In this instance, a ratio Hv/Ev may preferably be 2.5 to 20.

Further, the hydrocarbon wax also appropriately has the hydroxyl value (Hv) and the acid value (Av) while satisfying the following relationship:

Hv>Av, preferably Hv>2×Av.

In this instance, a ratio Hv/Av may preferably be 2.5 to 20.

As described above, the hydroxyl group of the hydrocarbon wax improves a slippability of the toner, thus enhancing a releasability of the toner from a fixing member. In addition to the hydroxyl group, the hydrocarbon wax has also the ester group showing a high affinity with the binder resin while satisfying the relationship of Hv>Ev, the hydrocarbon wax is uniformly present within the toner to improve the toner slippability with the fixing member and alleviate the toner attachment onto the fixing member. If the ester value is at least the Hv (Ev≧Hv), the affinity between the hydrocarbon wax and the binder resin becomes high, so that the hydrocarbon wax does not readily migrate to the toner surface. As a result, the function of the hydrocarbon wax is not readily exhibited, thus being liable to cause image soiling due to the toner attachment onto the fixing member.

The ester group of the hydrocarbon wax has a high affinity with a binder resin component and the hydroxyl group of the hydrocarbon wax has a high affinity with a fixation sheet (a sheet for carrying a toner image to be fixed thereon) such as paper, thus exhibiting an effect of discharging (removing) the toner from the fixing member. As a result, it becomes possible to improve the releasability of the toner with the fixing member and the dischargeability of the toner toward the fixation sheet, thus alleviating the image soiling due to attachment and accumulation of the toner onto the fixing member.

On the other hand, the acid group of the hydrocarbon wax has a high adhesive force with other toner components while satisfying the relationship of Hv>Av, thereby to keep a wax component at the toner surface on the fixing member. As a result, the hydrocarbon wax effectively functions at the boundary between the toner and the fixing member. If the acid value is at least the hydroxyl value (Av>Hv), the slippability of the hydrocarbon wax is lowered to cause image soiling due to the toner attachment onto the fixing member in some cases.

The hydrocarbon wax used in the present invention has the acid group and the ester group in combination, so that the hydrocarbon wax is dispersed with an appropriate dispersion diameter in toner particles, thus effectively exhibiting its function. If either one of the acid group and the ester group is not present in the hydrocarbon wax, the dispersion diameter of the hydrocarbon wax in toner particles becomes uniform, thus resulting in poor wax function in some cases.

Further, the high-molecular weight component of the THF-soluble content (of the toner) measured according to GPC shows a high releasability with the fixing member and is uniformly dispersed in toner particles based on such a function of the hydrocarbon wax as to impart an excellent mutual solubility between the high-molecular weight component and the low-molecular weight component to the toner according to the present invention, thus further improving the toner releasing effect against the fixing member.

The hydrocarbon wax used in the present invention is not only excellent in releasing function and plasticizing function in the case of being moderatedly finely dispersed in toner particles but also effectively improves the fixability and anti-offset characteristic of the toner because a main chain of hydrocarbon wax molecule has C—C bonds (i.e., a longer methylene group), thus readily exhibiting functions of respective groups such as acid group, hydroxyl group and ester group.

On the other hand, in the case where another element or bond is contained in a molecular main chain of hydrocarbon wax (e.g., when an ether bond (group) having oxygen is contained in a molecular main chain of hydrocarbon wax as in, e.g., polyglycerin), the function of hydrocarbon wax is lowered to impair the functions of the above-mentioned respective functional groups (acid, hydroxyl and ester groups), thus failing to achieve a good fixability and anti-offset characteristic.

In the present invention, the hydrocarbon wax may preferably be prepared by once forming a borate of wax from an aliphatic hydrocarbon wax and then subjecting the borate of wax to hydrolysis to obtain a wax having hydroxyl group (herein, the series of the above production steps is referred to as "alcoholic conversion"). The use of the alcoholic conversion is effective in providing a resultant wax with desired characteristics, in view of easy control of conversion degrees of acid group, hydroxyl group and ester group of a resultant hydrocarbon wax.

The aliphatic hydrocarbon wax may comprise saturated or unsaturated aliphatic hydrocarbons having a number-average molecular weight (Mn) (polyethylene-conversion value) of 100–3000, preferably 200–2000, more preferably 250–1000, as measured by GPC.

The molecular weight (distribution) of the hydrocarbon wax used in the present invention may be measured by GPC under the following conditions Apparatus "HLC-8121GPC/HT" (available from Toso K.K.)

Column "TSK gel GMHHR-H HT" 7.8 mm I.D. (inner diameter)×30 cm L (length)-binary (available from Toso K.K.)

Detector: RI detector for high temperature

Temperature: 135° C.

Solvent: o-dichlorobenzene containing 0.05 % of ionol.

Flow rate: 1.0 ml/min.

Sample: 0.4 ml of a 0.1 %-sample.

Based on the above GPC measurement, the molecular weight distribution of a sample is obtained once based on a calibration curve prepared by monodisperse polystyrene standard samples, and re-calculated into a distribution corresponding to that of polyethylene using a conversion formula based on the Mark-Houwink viscosity formula.

Examples of the aliphatic hydrocarbon wax may include: (A) a higher aliphatic unsaturated hydrocarbon having at least one double bond obtained through an ethylene polymerization process or olefin formation process using thermal decomposition of petroleum hydrocarbon, (B) a n-paraffin mixture obtained from a petroleum fraction, (C) a polyethylene wax obtained from the ethylene polymerization process, and (D) a higher aliphatic hydrocarbon obtained by the Fischer-Trospch process. These hydrocarbon waxes may be used singly or in combination of two or more species.

The hydrocarbon wax used in the present invention may be prepared by liquid-phase oxidizing an aliphatic hydrocarbon wax with molecular-form oxygen-containing gas in the presence of a catalylst, preferably boric acid and boric (acid,) anhydride. The resultant wax may be then subjected to purification according to the press sweating method, purification with a solvent, hydrogenation, or activated clay treatment after washing with sulfuric acid. Boric acid and boric anhydride may preferably be used in a mixture satisfying a mixing ratio (boric acid/boric anhydride) of 1 to 2, more preferably 1.2–1.7 (as molar ratio).

If the amount of boric anhydride is smaller to provided a mixing ratio of above 2, an excessive amount of boric acid is liable to undesirably cause aggregation or agglomeration. On the other hand, the amount of boric anhydride is larger to provide a mixing ratio of below 1, a powdery substance resulting from boric anhydride is recovered after the reaction and an excessive amount of boric anhydride does not contribute to the reaction, thus resulting in expensive production cost.

The mixture of boric acid and boric anhydride may preferably be added in an amount of 0.01 to 10 mol, more preferably 0.1 to 1 mol, as a boric acid-conversion amount, per 1 mol of an aliphatic hydrocarbon as a starting material.

As the catalyst, other than boric acid/boric anhydride mixture, it is possible to use metaboric acid, pyroboric acid, and oxyacids of boron, phosphorus, nitrogen and sulfur (e.g., boric acid, nitric acid, phosphoric acid and sulfuric acid).

The molecular-form oxygen-containing gas to be introduced into the reaction system may include oxygen gas, air and diluted gases thereof containing diluent inert gas. The gas may preferably have an oxygen concentration of 1–30 vol. %, more preferably 3–20 vol. %.

The liquid-phase oxidation (reaction) of the aliphatic hydrocarbon (starting material) may ordinarily performed with no solvent i a melted state thereof at a reaction temperature of 120–280° C., preferably 150–250° C., for preferably 1–15 hours.

Boric acid and boric anhydride may preferably be preliminarily blended and then added into the reaction system. If only boric acid is added singly into the reaction system, an undesirable reaction such as dehydration reaction of boric acid is liable to proceed.

Further, the mixture catalyst of boric acid and boric anhydride may preferably be added into the reaction system at 100–180° C., more preferably 110–160° C. If the addition temperature is below 100° C., a catalyst ability (effect) of boric anhydride is lowered due to, e.g., a residual water (moisture) content in the system.

After the reaction, water is added into the reaction mixture to precipitate a boric ester of wax, followed by hydrolysis and purification to obtain a hydrocarbon wax having desired functional groups to be used in the toner of the present invention. The hydrocarbon wax thus produced contains a substantial proportion of secondary alcohol component.

In the present invention, acid value, hydroxyl value, ester value and saponification value of the thus obtained hydrocarbon wax are based on those obtained basically according to JIS K-0070 in the following methods, respectively.

Measurement of Acid Value (Av)

<Apparatus or Equipments>

Erlenmeyer flask (300 ml)

Buret (25 ml)

Water bath or hot plate

<Reagents>

0.1 kmol/$m^3$-hydrochloric acid (HCl)

0.1 kmol/$m^3$-potassium hydroxide (KOH) solution in ethanol (standardization thereof is performed in such a manner that 25 ml of 0.1 kmol/$m^3$-HCl is placed in an Erlenmeyer flask by using a whole pipet is, after adding a phenolphthalein solution (prepared below) thereto, subjected to titration with 0.1 kmol/$m^3$-KOH ethanol solution to obtain an amount required for neutralization, thus determining a factor of the 0.1 kmol/$m^3$-KOH ethanol solution).

Phenolphthalein Solution (indicator)

Solvent (a mixture of diethyl ether/99.5 %-ethanol (=1:1 or 2:1 by volume) which is used immediately after being neutralized with 0.1 kmol/$m^3$-KOH ethanol solution in the presence of several drops of phenolphthalein solution).

<Measurement>

(a) 1–20 g of a wax is accurately weighed in an Erlenmeyer flask.

(b) To the wax, 100 ml of solvent and several drops of phenolphthalein solution (indicator) are added, followed by shaking on a water bath to completely dissolve the wax.

(c) The resultant wax solution is subjected to titration with 0.1 kmol/$m^3$-KOH ethanol solution to determine an end point when a pale red state of the wax solution (by the phenolphthalein indicator) is kept for 30 sec.

<Calculation>

The acid value (Av) of the wax is calculated according to the following formula:

$$A = 5.611 \times B \times f / S,$$

wherein A denotes an acid value (Av) (mgKOH/g) of wax, B denotes an amount (ml) of 0.1 kmol/$m^3$-KOH ethanol solution used for titration, f denotes a factor of 0.1 kmol/$m^3$-KOH ethanol solution, S denotes a weight (g) of wax, and "5.611" means 1/10 of a formula weight (56.11) of potassium hydroxide (KOH).

Measurement of Hydroxyl Value (Hv)

<Apparatus or Equipments)

Measuring cylinder (100 ml)

Whole pipet (5 ml)

Flat-bottomed flask (200 ml)

Glycerin bath

<Reagents>

Acetylating reagent (prepared by placing 25 g of acetic anhydride in a 100 ml-whole flask together with pyridine so as to provide a total volume of 100 ml, followed by sufficient shaking).

Phenolphthalein Solution (Indicator)

0.5 kmol/$m^3$-potassium Hydroxide (KOH) Solution in Ethanol

<Measurement>

(a) 0.5–6.0 g of a wax is accurately weighed in a flat-bottomed flask and to the wax, 5 ml of an acetylating reagent is added by using a whole pipet.

(b) A small fennel is placed on an opening portion of the flask and the wax is heated in a glycerin both kept at 95–100° C. while immersing the flask in the glycerin bath at the bottom in an immersion depth of 1 cm. At that time, the neck of the flask is covered with a bored (hollow-circular boxboard in order to prevent temperature increase under heating at the neck portion of the flask.

(c) The flask is taken out from the glycerin bath after 1 hour, followed by cooling at room temperature. After the cooling, 1 ml of water is added into the flask via the funnel, followed by shaking to decompose acetic anhydride.

(d) In order to effect a complete decomposition, the flask is heated again on the glycerin bath for 10 min. After cooling, the funnel and the inner wall of the flask a rewashed with 5 ml of 95 %-ethanol.

(e) The resultant system is subjected to titration with 0.5 kmol/$m^3$-KOH ethanol solution in the presence of several drops of phenolphthalein solution to determine an end point when a pale red state of the system (by the phenolphthalein indicator) is kept for 30 sec.

(f) Separately, the above operations (a) to (e) are performed without adding the wax as a blank test.

(g) If the sample wax is not readily dissolved, a small amount of pyridine, xylene or toluene may be added for dissolution.

<Calculation>

The hydroxyl value (Hv) of the wax is calculated according to the following formula:

$$A = \{[(B-C) \times 28.05 \times f]/S\} + D,$$

wherein A denotes a hydroxyl value (Hv) (mgKOH/g) of wax, B denotes an amount (ml) of 0.5 kmol/$m^3$-KOH ethanol solution used for the bank test, C denotes an amount (ml) of 0.5 kmol/$m^3$-KOH ethanol solution used for the titration (of wax), f denotes a factor of 0.5 kmol/$m^3$-KOH ethanol solution, S denotes a weight (g) of wax, D denotes an acid value (Av) of wax, and "28.05" means ½ of a formula weight (56.11) of KOH.

Ester Value (Ev)

The ester value (Ev) (mgKOH/g) of wax is determined based on the following formula:

$$Ev\ (\text{mgKOH/g}) = Sv\ (\text{saponification value})\ (\text{mgKOH/g}) - Av(\text{mgKOH/})$$

Measurement of Saponification Value (Sv) of Wax

<Apparatus or Equipments>

Erlenmeyer flask (200–300 ml)

Condenser (outer diameter=6–8 mm, length=100 cm, glass tube or reflux-condenser capable of being fit into an opening portion of Erlenmeyer flask)

Water bath, sand bath or hot plate (capable of being adjusted at ca. 80° C.)

Buret (50 ml)

Whole pipet (25 ml)

<Reagents>

0.5 kmol/$m^3$-hydrochloric acid (HCl)

0.5 kmol/$m^3$-potassium hydroxide (KbH) solution in ethanol

Phenolphthalein solution

<Measurement>

(a) 1.5–3.0 g of a wax is accurately weighed (up to a digit of 1 mg) in an Erlenmeyer flask.

(b) To the wax, 25 m of 0.5 kmol/$m^3$-KOH ethanol solution is added by using a whole pipet.

(c) The Erlenmeyer flask is equipped with a condenser and moderately heated for reaction on a after bath, a sand bath or a hot plate while sometimes shaking the system. At that time, the heating temperature is controlled so that an upper (ring) portion of ethanol to be refluxed does not reach an upper end of the condenser.

(d) After the reaction, the system is immediately cooled and a small amount of water or mixture solution of xylene/ethanol (=1:3) is blown toward the inner wall of the flask via the condenser so as to prevent solidification of the system in a gelatin form.

(e) The resultant system is subjected to titration with 0.5 kmol/$m^3$-HCl presence of 1 ml of phenolphthalein solution to determine an end point when a pale red state of the system (by the phenolphthalein indicator) is kept for ca. 1 min.

(f) Separately, the above operations (a) to (e) are performed without adding the wax as a blank test.

(g) If the sample wax is not readily dissolved, a small amount of xylene or xylene-ethanol mixture solvent may be preliminarily added for dissolution.

<Calculation>

The saponification value (Sv) of the wax is calculated according to the following formula:

$$A=[(B-C)\times 28.05\times f]/S,$$

wherein A denotes a saponification value (Sv) (mgKOH/g) of wax, B denotes an amount (ml) of 0.5 kmol/$m^3$-HCl used for the bank test, C denotes an amount (ml) of 0.5 kmol/$m^3$-HCl used for the titration (of wax), f denotes a factor of 0.5 kmol/$m^3$HCl solution, S denotes a weight (g) of wax, and "28.05" means ½ of a formula weight (56.11) of KOH.

In the case where an acid value (Av), hydroxyl value (Hv), ester value (Ev) and saponification value (Sv) of a wax contained in the toner according to the present invention are measured, a sample wax for measurement may be prepared by recovering a waxy component from the toner.

The hydrocarbon wax used in the present invention may preferably have a melting point (Tmp) of 65–130° C., more preferably 70–125° C., further preferably 75–120° C.

By using the hydrocarbon wax having a Tmp in the above range in the toner of the present invention, it is possible to further enhance the plasticizing effect of the wax to the toner, thus improving a toner fixability. Further, in the case where a fixing member is excessively heated, the hydrocarbon wax readily migrates from the inside of toner particles, thus improving an anti-offset characteristic at high temperatures.

If the melting point (Tmp) of the hydrocarbon wax is below 65° C., an anti-blocking characteristic of the resultant toner is liable to be lowered. Above 130° C., a fixing performance of the toner is adversely affected in some cases.

In the present invention, the melting point (Tmp) of the hydrocarbon wax may be measured by using a differential scanning calorimeter ("DSC-7", available from Perkin-Elmer Corp.) according to ASTM D3418-82.

A sample wax in an amount of 0.5–2 mg, preferably 1 mg is accurately weighed. The sample wax is placed on an aluminum pan and subjected to measurement in parallel with a blank aluminum pan as a reference. The measurement is performed in a temperature range of 10–180° C. at a temperature-raising rate of 10° C./min after subjected to a temperature increase from 20° C. to 180° C. at a rate of 10° C. min and then a temperature decrease from 180° C. to 10° C. at a rate of 10° C./min. A temperature providing a heat-absorption peak measured in the temperature range of 10–180° C. is taken as a melting point (°C.).

The hydrocarbon wax used in the present invention may preferably have a penetration of at most 15, more preferably at most 12, further preferably at most 10, in view of an improved toner chargeability and a good developing performance even in a high temperature/high humidity environment.

If the penetration of the hydrocarbon wax is above 15, an anti-blocking characteristic of the toner is liable to be lowered.

The penetration of the hydrocarbon wax may be measured according to JIS K-2235.

The hydrocarbon wax may preferably be contained in the toner of the present invention in an amount of 0.2–20 wt. parts, more preferably 0.5–15 wt. parts, further preferably 1–15 wt. parts, per 100 wt. parts of the binder resin.

The hydrocarbon wax used in the present invention may preferably have a viscosity at 120° C. of at most 500 mPa.s, more preferably at most 200 mPa.s, further preferably at most 100 mPa.s, in order to a lower a melt viscosity of the toner to provide a good developing performance.

If the viscosity at 120° C. of the hydrocarbon wax is above 500 mPa.s, a fixability of the toner is liable to be lowered.

The viscosity of the hydrocarbon wax may be measured according to JIS K-6862-7.2.

The hydrocarbon wax used in the present invention may preferably have a softening point of 65 140° C., more preferably 70–130° C., further preferably 75–120° C., in view of good fixability, anti-offset characteristic, and anti-blocking characteristic of the toner.

If the softening point of the hydrocarbon wax is below 65° C., the anti-offset characteristic and anti-blocking characteristic of the toner are liable to be lowered. Above 140° C., the fixability of the toner becomes insufficient in some cases.

The softening point of the hydrocarbon wax may be measured according to JIS K-2207-6.4.

The hydrocarbon wax used in the present invention may be used in combination with another wax including those generally known in the art.

Examples of another wax may include: paraffin waxes and their derivatives, montan waxes and their derivatives, microcrystalline waxes and their derivatives, Fischer-Tropsch wax and its derivatives, polyolefin waxes and their derivatives, and carnauba wax and its derivatives. Examples of the derivatives of the above waxes may be oxidized products, block copolymers with vinyl monomer(s) and graft-modified products.

Such another wax (used in combination with the hydrocarbon wax) may preferably be contained in the toner of the present invention in an amount of 0.2–20 wt. parts, more preferably 0.5–15 wt. parts, further preferably 1–15 wt. parts, per 100 wt. parts of the binder resin.

Examples of the binder resin constituting the toner of the present invention may include styrene resins, styrene copolymer resins, polyester resins, polyol resins, polyvinyl chloride resin, phenolic resin, natural resin-modified phenolic resin, natural resin-modified maleic acid resin, acrylic resin, methacrylic resin, polyvinyl acetate, silicone-resin, polyurethane resin, polyamide resin, furan resin, epoxy resin, epoxy resin, xylene resin, polyvinyl butyral, terpene resin, coumarone-indene resin, and petroleum resin.

Examples of comonomers for constituting the styrene copolymers as a preferred class of binder resin together with styrene monomer may include: styrene derivatives, such as vinyltoluene; acrylic acid; acrylate esters, such as methyl acrylate, ethyl acrylate, butyl acrylate, dodecyl acrylate, octyl acrylate, 2-ethylhexyl acrylate and phenyl acrylate; methacrylic acid; methacrylate esters, such as methyl methacrylate, ethyl methacrylate, butyl methacrylate, and octyl methacrylate; maleic acid; dicarboxylic acid esters having a double bond, such as butyl maleate, methyl maleate, and dimethyl maleate; acrylamide, acrylonitrile, methacrylonitrile, butadiene; vinylesters, such as vinyl chloride, vinyl acetate and vinyl benzoate; olefins, such as ethylene, propylene and butylene; and vinyl ketones, such as vinyl methyl ketone and vinyl hexyl ketone. These vinyl monomers may be used singly or in combination of two or more species.

The toner according to the present invention may preferably have an acid value of 0.5–100 mgKOH/g, more preferably 0.5–50 mgKOH/g, further preferably 1.0–40 mgKOH/g. In case where the acid value of the toner is in the above-described range, it is possible to further improve a dispersibility of the hydrocarbon wax, thus achieving good developing performance and stable developing performance over a long period.

These effects sufficiently exhibited when the acid value of the binder resin is 1–100 mgKOH/g, more preferably 1–70 mgKOH/g, further preferably 1–50 mgKOH/g, particularly preferably 2–40 mgKOH/g.

The acid value of a toner or a binder resin described herein are based on values measured in the following manner.

<Acid Value Measurement>

The basic operation is according to JIS K-070.

1) A toner or a binder resin is pulverized, and 0.5–2.0 g of the pulverized sample is accurately weighed to provide a sample containing W (g) of toner or binder.

2) The sample is placed in a 300-ml beaker, and 150 ml of a toluene/ethanol (4/1) mixture liquid is added thereto to dissolve the sample.

3) The sample solution is (automatically) titrated with a 0.1 mol/liter-KOH solution in ethanol by means of a potentiometric titration apparatus (e.g., "AT-400 (win workstation)" with an "ABP-410" electromotive buret, available from Kyoto Denshi K.K.).

4) The amount of the KOH solution used for the titration is recorded at S (ml), and the amount of the KOH solution used for a blank titration is measured and recorded at B (ml).

5) The acid value is calculated according to the following equation:

Acid value (mgKOH/g)=$\{(S-B)\times f\times 5.61\}/W$, wherein f denotes a factor of the 0.1 mol/liter-KOH solution.

Examples of monomers for adjusting the acid value of the binder resin may include: acrylic acids and α- and β-alkyl derivatives, such as acrylic acid, methacrylic acid, and α-ethylacrylic acid; other unsaturated monocarboxylic acids, such as crotonic acid, cinnamic acid, vinylacetic acid, isocrotonic acid, and angelic acid; and unsaturated dicarboxylic acids, such as fumaric acid, maleic acid, citraconic acid, alkenylsuccinic acid, itaconic acid, mesaconic acid, dimethylmaleic acid, and dimethylfumaric acid, and their monoester derivatives and anhydrides. These monomers may be used singly or in mixture of two or more species for copolymerization with another monomer to obtain a desired binder resin. Among these, monoester derivatives of unsaturated dicarboxylic acids are particularly preferred for the acid value control.

The monoester derivatives of unsaturated dicarboxylic acids may include monoesters of α,β-unsaturated dicarboxylic acids, such, as monomethyl maleate, monoethyl maleate, monobutyl maleate, monooctyl maleate, monoallyl maleate, monophenyl maleate, monomethyl fumarate, monoethyl fumarate, monobutyl fumarate and monophenyl fumarate; and monoesters of alkenyldicarboxylic acids, such as monobutyl n-butenylsuccinate, monomethyl n-octenylsuccinate, monoethyl n-butenylmalonate, monomethyl n-dodecenylglutarate, and monobutyl n-butenyladipate.

Such a carboxyl group-containing monomer may be added in 0.1–20 wt. parts, preferably 0.2–15 wt. parts per 100 wt. parts of the total monomers for constituting the binder resin.

The above-mentioned monoester of dicarboxylic acid is preferred because it is an ester which has a low solubility in aqueous dispersion medium and a high solubility in an organic solvent or another monomer.

The toner binder resin or binder resin composition used in the present invention may preferably have a glass transition temperature (Tg) of 45–80° C., preferably 50–70° C., in view of the storability of the resultant toner. In case of a Tg below the above-mentioned range, the resultant toner is liable to be degraded in a high temperature environment and cause offsetting at the time of fixation. If the Tg is higher than the above range, the resultant toner is liable to exhibit an inferior fixability.

The binder resin for constituting the toner of the present invention may be produced through a polymerization process, such as solution polymerization, emulsion polymerization and suspension polymerization.

In the emulsion polymerization process, a monomer almost insoluble in water is dispersed as minute particles in an aqueous phase with the aid of an emulsifier and is polymerized by using a water-soluble polymerization initiator. According to this method, the control of the reaction temperature is easy, and the termination reaction velocity is small because the polymerization phase (an oil phase of the vinyl monomer possibly containing a polymer therein) constitutes a separate phase from the aqueous phase. As a result, the polymerization velocity becomes large and a polymer having a high polymerization degree can be prepared easily. Further, the polymerization process is relatively simple, the polymerization product is obtained in fine particles, and additives such as a colorant, a charge control agent and others can be blended easily for toner production. Therefore, this method can be advantageously used for production of a toner binder resin.

In the emulsion polymerization, however, the emulsifier added is liable to be incorporated as an impurity in the polymer produced, and it is necessary to effect a post-treatment such as salt-precipitation in order to recover the product polymer at a high purity. The suspension polymerization is more convenient in this respect.

The suspension polymerization may preferably be performed by using at most 100 wt. parts, preferably 10–90 wt. parts, of a monomer (mixture) per 100 wt. parts of water or an aqueous medium. The dispersing agent may include polyvinyl; alcohol, partially saponified form of polyvinyl alcohol, and calcium phosphate, and may preferably be used in an amount of 0.05–1 wt. part per 100 wt. parts of the aqueous medium. The polymerization temperature may suitably be in the range of 50–95° C. and selected depending on the polymerization initiator used and the objective polymer.

The binder resin may preferably be produced in the presence of a polyfunctional polymerization initiator and/or a monofunctional polymerization initiator, as enumerated hereinbelow.

Specific examples of the polyfunctional polymerization initiator may include polyfunctional polymerization initiators having at least two functional groups having a polymerization-initiating function, such as peroxide groups, per molecule, inclusive of 1,1-di-t-butylperoxy-3,3,5-trimethylcyclohexane, 1,3-bis-(t-butylperoxyisopropyl) benzene, 2,5-dimethyl-2,5-(t-butylperoxy)hexane, 2,5-dimethyl-2,5-di-(t-butylperoxy)hexine-3, tris(t-butylperoxy)-triazine, 1,1-di-t-butylperoxycyclohexane, 2,2-di-t-butylperoxybutane, 4,4-di-t-butylperxyvaleric acid n-butyl ester, di-t-butylperoxyhexahydroterephthalate, di-t-butylperoxyazelate, di-t-butylperoxytrimethyl-adipate, 2,2-bis-(4,4-di-t-butylperoxycyclohexyl)-propane, 2,2-t-butylperoxyoctane and various polymer oxides; and polyfunctional polymerization initiators having both a polymerization-initiating functional group, such as peroxide group, and a polymerizable unsaturation group in one molecule, such as diallylperoxydicarbonate, t-butylperoxymaleic acid, t-butylperoxyallylcarbonate, and t-butylperoxyisopropylfumarate.

Among these, particularly preferred examples may include 1,1-di-t-butylperoxy-3,3,5-trimethylcyclohexane, 1,1-di-t-butylperoxycyclohexane, di-t-butylperoxyhexahydroterephthalate, di-t-butylperoxyazelate, 2,2-bis(4,4-di-t-butylperoxycyclohexyl)-propane, and t-butylperoxyallylcarbonate.

These polyfunctional polymerization initiators may preferably be used in combination with a monofunctional polymerization initiator, more preferably with a monofunctional polymerization initiator having a 10 hour-halflife temperature (a temperature providing a halflife of 10 hours by decomposition thereof) which is lower than that of the polyfunctional polymerization initiator, so as to provide a toner binder resin satisfying various requirements in combination.

Examples of the monofunctional polymerization initiator may include organic peroxides, such as benzoyl peroxide, 1,1-di(t-butylperoxy)-3,3,5-trimethylcyclohexane, n-butyl-4,4-di(t-butylperoxy)-volerate, dicumyl peroxide, α,α-bis(t-butylperoxy-diisopropyl)benzene, t-butylperoxycumene and di-t-butyl peroxide; and azo and diazo compounds, such as azobisisobutyronitrile, and diazoaminoazobenzene.

The monofunctional polymerization initiator can be added to the monomer simultaneously with the above-mentioned polyfunctional polymerization initiator but may preferably be added after lapse of a polymerization time which exceeds the halflife of the polyfunctional polymerization initiator, in order to appropriately retain the initiator efficiency of the polyfunctional polymerization initiator.

The above-mentioned polymerization initiators may preferably be used in an amount of 0.05–2 wt. parts per 100 wt. parts of the monomer in view of the efficiency.

It is also preferred that the binder resin has been crosslinked with a crosslinking monomer as enumerated hereinbelow.

The crosslinking monomer may principally be a monomer having two or more polymerizable double bonds. Specific examples thereof may include: aromatic divinyl compounds, such as divinylbenzene and divinylnaphthalene; diacrylate compounds connected with an alkyl chain, such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate, and compounds obtained by substituting methacrylate groups for the acrylate groups in the above compounds; diacrylate compounds connected with an alkyl chain including an ether bond, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate and compounds obtained by substituting methacrylate groups for the acrylate groups in the above compounds; diacrylate compounds connected with a chain including an aromatic group and an ether bond, such as polyoxyethylene(2)-2,2-bis(4-hydroxyphenyl) propanediacrylate, polyoxyethylene(4)-2,2-bis(4-hydroxyphenyl)-propanediacrylate, and compounds obtained by substituting methacrylate groups for the acrylate groups in the above compounds; and polyester-type diacrylate compounds, such as one known by a trade name of MANDA (available from Nihon Kayaku K.K.). Polyfunctional crosslinking agents, such as pentaerythritol triacrylate, trimethylethane triacrylate, tetramethylolmethane tetracrylate, oligoester acrylate, and compounds obtained by substituting methacrylate groups for the acrylate groups in the above compounds; triallyl cyanurate and triallyl trimellitate.

These crosslinking monomers may preferably be used in a proportion of 0.00001–1 wt. part, particularly about 0.001–0.05 wt. part, per 100 wt. parts of the other monomer components.

Among the above-mentioned crosslinking monomers, aromatic divinyl compounds (particularly, divinylbenzene) and diacrylate compounds connected with a chain including an aromatic group and an ether bond may suitably be used in a toner resin in view of fixing characteristic and anti-offset characteristic.

Other polymerization processes, such as bulk polymerization and solution polymerization can also be utilized. The bulk polymerization allows production of a low-molecular weight polymer by adopting a high polymerization temperature providing an accelerated termination reaction speed, but the reaction cannot be controlled easily. In contrast thereto, according to the solution polymerization process, a polymer having a desired molecular weight can be produced easily under moderate conditions by utilizing the radical chain transfer function of the solvent and by adjusting the polymerization initiator amount or reaction temperature, so that the solution polymerization process is preferred. It is also effective to perform the solution polymerization under an elevated pressure, so as to suppress the amount of the polymerization initiator to the minimum and suppress the adverse effect of the residual polymerization initiator.

For providing the binder resin (composition) used in the present invention, it is possible to rely on various methods, inclusive of a solution blending method wherein a high-molecular weight polymer and a low-molecular weight polymer are separately produced and are blended in a solution state, followed by removal of the solvent; a dry blending method of melt-kneading a high-molecular weight polymer and a low-molecular weight polymer in, e.g., an extruder; and a two-step polymerization method wherein a low-molecular weight polymer prepared by, e.g., solution polymerization is dissolved in a monomer for constituting a high-molecular weight polymer, and the resultant mixture is subjected to suspension polymerization, followed by washing and drying of the polymerizate to provide a resin composition. The dry blendng method has left room for improvement in uniform dispersibility and mutual solubility. The two-step polymerization process is advantageous for realizing uniform dispersion, but is accompanied with a difficulty that an unnecessary low-molecular weight component is liable to be by-produced. The solution blending method is free from such a problem and allows the inclusion of the low-molecular weight component in a larger amount than the high-molecular weight component, so that it is most preferred. For the purpose of providing the low-molecular weight component with a prescribed acid value, it is preferred to rely on the solution polymerization which allows easier setting of the acid value than in the aqueous-system polymerization.

Further, in the case of using a polyester resin in the binder resin, the polyester resin may have a composition as described below.

Examples of an alcohol component may include: diols, such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenols and derivatives represented by the following formula (A):

(A)

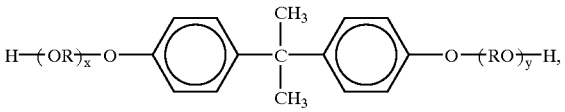

wherein R denotes an ethylene or propylene group, x and y are independently an integer of at least 0 with the proviso that the average of x+y is in the range of 0–10; diols represented by the following formula (B):

(B)

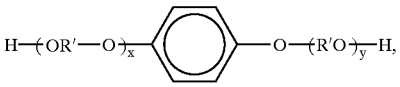

wherein R' denotes

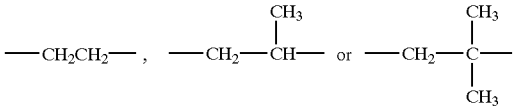

and x' and y' are independently an integer of at least 0 with the proviso that the average of x'+y' is in the range of 0–10.

Examples of a dibasic acid may include dicarboxylic acids and derivatives thereof inclusive of: aromatic dicarboxylic acids, such as phthalic acid, terephthalic acid and isophthalic acid, and their anhydrides; alkyldicarboxylic acids, such as succinic acid, adipic acid, sebacic acid and azelaic acid, and their anhydrides and lower alkyl esters thereof; alkenyl- or alkyl-succinic acids, such as n-dodecenylsuccinic acid and n-dodecylsuccinic acid, and their anhydrides and lower alkyl esters thereof; and unsaturated dicarboxylic acids, such as fumaric acid, maleic acid, citraconic acid and itaconic acid, and their anhydrides and lower alkyl esters thereof.

It is preferred to also include a polyhydric alcohol component having at least three hydroxyl groups and/or a polycarboxylic acid component having at least three carboxyl groups.

Examples of the polyhydric alcohol having at least three hydroxyl groups may include: sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, -and 1,3,5-trihydroxybenzene.

Examples of the polycarboxylic acid having at least three carboxyl groups may include polycarboxylic acids and derivatives thereof inclusive of: trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetracarboxylic acid, Empole trimer acid, and anhydrides and lower alkyl esters of these; and tetracarboxylic acids represented by the following formula, and anhydrides and lower alkyl esters thereof:

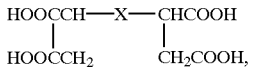

wherein X denotes an alkylene group or alkenylene group of 5–30 carbon atoms having at least one side chain of at least one carbon atom.

It is preferred that the alcohol component(s) may occupy 40–60 mol. %, preferably 45–55 wt. %, and the acid component(s) may occupy 60–40 mol. %, preferably 55–45 mol. %, respectively, of the polyester forming monomers components. It is preferred that the polyhydric alcohol having at least three hydroxyl groups may occupy 5–60 mol. % of the total components. Similarly, it is preferred that the polycarboxylic acid having at least three carboxyl group may occupy 5–60 mol. % of the total components.

The polyester resin may be produced through an ordinary polycondensation process.

The toner according to the present invention may preferably contain a negative or positive charge control agent.

Examples of the negative charge control agent may include: organic metal complexes and chelate compounds inclusive of monoazo metal complexes acetylacetone metal complexes, and organometal complexes of aromatic hydroxycarboxylic acids and aromatic dicarboxylic acids. Other examples may include aromatic hydroxycarboxylic acids, aromatic mono- and poly-carboxylic acids, and their metal salts, anhydrides and esters, and phenol derivatives, such as bisphenols. Among the above, a monoazo metal complex represented by the formula (1) below is preferred.

(1)

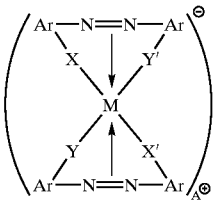

wherein M is a central metal of coordination, such as Sc, Ti, V, Cr, Co, Ni, Mn or Fe; Ar is an aryl group, such as phenyl or naphthyl, capable of having a substituent, such as nitro group, halogen, carboxyl group, anilide group, an alkyl group having 1–18 carbon atoms, or an alkoxy group having 1–18 carbon atoms; X, X', Y and Y' independently denote —O—,—CO—, —NH—or —NR—(R=$C_{1-4}$ alkyl); and $A^{\oplus}$ is hydrogen, ion, sodium ion, potassium ion, ammonium ion, aliphatic ammonium ion, or an ion mixture of these ions.

In the above formula (1), M may preferably be Fe or Cr and the substituent for Ar group may preferably be halogen, alkyl group or anilide group. Further, the counter ion $A^{\oplus}$ may preferably be hydrogen ion, alkaline metal ion, ammonium ion or aliphatic ammonium ion. In addition, a mixture of complex salts having different counter ions may preferably be used.

As the negative charge control agent, it is also preferred to use a basic organic acid metal complex represented by the following formula (2):

(2)

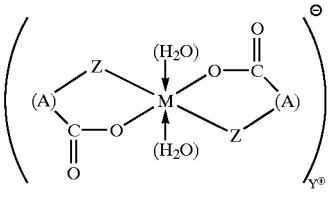

wherein M is a central metal of coordination, such as Cr, Co, Ni, Mn, Fe, Zn, Al, Si, or B; A is

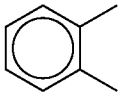

(optionally having an alkyl substituent),

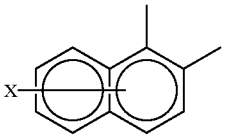

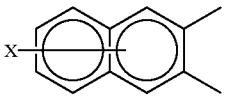

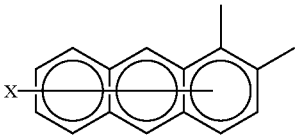

-continued

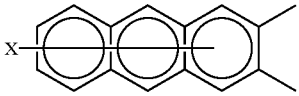

(where X is hydrogen, halogen, nitro group or alkyl group) and

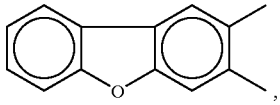

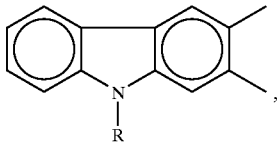

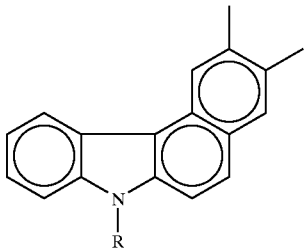

(where R is hydrogen or $C_{1-18}$ alkyl group or $C_{2-18}$ alkenyl group); $Y^+$ is hydrogen ion, sodium ion, potassium ion, ammonium ion, aliphatic ammonium ion or an ion mixture of these ions; and Z is —O— or

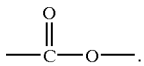

In the above formula (2), M may preferably be Fe, Cr, Si, Zn or Al and the substituent for A may preferably be alkyl group, anilide group, aryl group or halogen. Further, the counter ion $Y^+$ may preferably be hydrogen ion, ammonium ion or aliphatic ammonium ion.

Examples of the positive charge control agents may include: nigrosine and modified products thereof with aliphatic acid metal salts, etc., onium salts inclusive of quaternary ammonium salts, such as tributylbenzylammonium 1-hydroxy-4-naphtholsulfonate and tetrabutylammonium tetrafluoroborate, and their homologous inclusive of phosphonium salts, and lake pigments thereof; triphenylmethane dyes and lake pigments thereof (the laking agents including, e.g., phosphotungstic acid, phosphomolybdic acid, phosphotungsticmolybdic acid, tannic acid, lauric acid, gallic acid, ferricyanates, and ferrocyanates); higher aliphatic acid metal salts; diorganotin oxides, such as dibutyltin oxide, dioctyltin oxide and dicyclohexyltin oxide; diorganotin borates, such as dibutyltin borate, dioctyltin borate and dicyclohexyltin borate; guanidine compounds; and triphenylmethane compounds. These may be used singly or in mixture of two or more species. Among these, triphenylmethane compounds and quaternary ammonium salts free from halogen as a counter ion are preferred.

It is also possible to use a homopolymer of a monomer represented by the following formula (3):

(3)

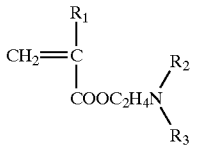

wherein $R_1$ is H or $CH_3$, and $R_2$ and $R_3$ each is a substituted and unsubstituted alkyl group (preferably having 1–4 carbon atoms), or a copolymer of the above monomer with another (polymerizable) monomer described above, such as styrene, acrylate or methacrylate, as the positive charge control agent. In this case, the homopolymer or the copolymer may function as both of the charge control agent and (a part of or total of) the binder resin.

In the present invention, as the positive charge control agent, it is particularly preferred to use a triphenylmethane compound represented by the following formula (4):

(4)

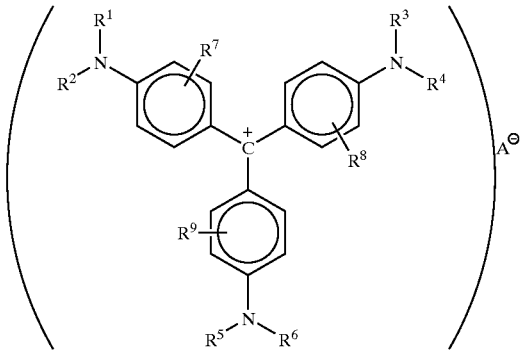

wherein $R^1$ to $R^6$ may be the same or different from each other and independently represent hydrogen, a substituted or unsubstituted alkyl group or a substituted or unsubstituted aryl group; $R^7$ to $R^9$ may be the same or different from each other and independently represent hydrogen, halogen, alkyl group or alkoxy group; and $A^+$ represents an anion, such as sulfate ion, nitrate ion, borate ion,phosphate ion, hydroxyl ion, organic sulfate ion, organic sulfonate, organic phosphate ion, carboxylate ion, organic borate ion or tetrafluoroborate.

The above-mentioned charge control agent may be internally or externally added in toner particles in an appropriate amount while taking the type of the binder resin, presence or absence of other additives and a toner production method including a dispersion method into consideration. The charge control agent may preferably be contained in an amount of 0.1–10 wt. parts, more preferably 0.1–5 wt. parts, per 100 wt. parts of the binder resin.

The toner of the present invention may be used as a magnetic (mono-component) toner by incorporating a magnetic material in the toner. The magnetic material used for this purpose may for example comprise: an iron oxide such as magnetite, maghemite or ferrite; a metal, such as iron, cobalt or nickel, or an alloy of these metals with another metal, such as aluminum, cobalt, copper, lead, magnesium, tin, zinc, antimony, beryllium, bismuth, cadmium, calcium, manganese, selenium, titanium, tungsten or vanadium. It is preferred that the magnetic material contains a non-iron element at the surface or inside of the particles thereof.

The magnetic particles may preferably have a number-average particle size of 0.05–1.0 $\mu$m, more preferably 0.1–0.5 $\mu$m, and a BET specific area of 2–40 $m^2$/g, more preferably 4–20 $m^2$ /g. The magnetic particles may assume an arbitrary particle shape without particular restriction. The magnetic particles may preferably have magnetic properties including a saturation magnetization of 10–200 $Am^2$/kg, more preferably 70–100 $Am^2$/kg, as measured under a magnetic field of 795.8 kA/m, a residual magnetization of 1–100 $Am^2$/kg, more preferably 2–20 $Am^2$/kg, and a coercive force of 1–30 kA/m, more preferably 2–15 kA/m. The magnetic material may preferably be used in 20–200 wt. parts, more preferably 40–150 wt. parts, per 100 wt. parts of the binder resin.

The number-average particle size of magnetic particles may be determined by taking enlarged photographs taken through a transmission electron microscope and processing images of particles on the enlarged photographs by a digitizer, etc., to determine a particle size distribution and a number-average particle size therefrom. Further, the magnetic properties described herein are based on values measured by applying an external magnetic field of 795.8 kA/m by using a vibrating sample-type magnetometer ("VSM-3S-15", available from Tosei Kogyo K.K.). The specific surface areas are based on values measured according to the BET multi-point method using nitrogen gas as adsorbent on a sample surface by using a specific surface area meter ("Autosorb 1", available from Yuasa Ionics K.K.).

The toner according to the present invention contains a colorant. Examples thereof may include appropriate pigments and dyes. Examples of the pigments may include carbon black, an aniline black, acetylene black, Naphthol Yellow, Hansa Yellow, Rhodamine Lake, Alizarin Lake, cokothar Phthalocyanine Blue, and Indanthrene Blue. These pigments may be used in an amount necessary and sufficient to provide a fixed image with a desired optical density, e.g., in 0.1–20 wt. parts, preferably 0.2–10 wt. parts per 100 wt. parts of the binder resin. For a similar purpose, a dye may be used, and examples thereof may include: azo dyes, anthraquinone dyes, xanthene dyes and methine dyes. The dye may be added in 0.1–20 wt. parts, preferably 0.3–10 wt. parts per 100 wt. parts of the binder resin.

In the toner of the present invention, it is preferred to externally add hydrophillic or hydrophobic inorganic fine powder. Examples of such inorganic fine powder may include: silica fine powder, titanium oxide fine powder, and hydrophobized products thereof. These fine powders may be used singly or in mixture of two or more species thereof.

Silica fine powder may be dry process silica (sometimes called fumed silica) formed by vapor phase oxidation of a silicon halide or wet process silica formed from water glass. However, dry process silica is preferred because of fewer silanol groups at the surface and inside thereof and also fewer production residues (such as $Na_2O_3$ and $SO_3^{2-}$).

Silica fine powder may preferably be made hydrophobic through a hydrophobization treatment. Such a hydrophobization treatment may be effected by treating silica fine powder with a chemical agent, such as an organosilicon compound, reactive with or physically adsorbable by silica fine powder. A preferred example of hydrophobization process may comprise treating dry process silica fine powder formed through vapor-phase oxidation of a silicon halide with a silane compound and, thereafter or simultaneously therewith, treating the silica fine powder with an organosilicon compound, such as silicone oil.

Examples of such a silane compound used for the hydrophobization may include hexamethyl disilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyl trichlorosilane, β-chloroethyltrichlbrosilane, chloromethyldimethylchlorosilane, triorganosilyl mercaptans such as trimethylsilylmercaptan, triorganosilyl acrylates, vinyldimethylacetoxysilane, dimethylethoxysilane, dimethyldimethbxysilane, diphenyldiethoxysilane, hexamethyldisiloxane, 1,3-divinyltetramethyldisiloxane, and 1,3-diphenyltetra methyldisiloxane. These may be used alone or as a mixture of two or more compounds.

Silicone oil as a preferred class of organosilicon compound for hydrophobization may preferably have a viscosity at 25° C. of ca. 30–1,000 $mm^2/S$. Particularly preferred examples thereof may include: dimethylsilicone oil, methylphenylsilicone oil, α-methylstyrene-modified silicone oil, chlorophenylsilicone oil, and fluorine-containing silicone oil.

The silicone oil treatment may be performed, e.g., by directly blending silica fine powder preliminarily treated with a silane compound and silicone oil by means of a blender such as a Henschel mixer; by spraying silicone oil onto base silica fine powder; or by dissolving or dispersing silicone oil in an appropriate solvent and adding thereto base silica fine powder for blending, followed by removal of the solvent.

In a preferred embodiment of hydrophobization treatment, silica fine powder is preliminarily treated successively with dimethyldichlorosilane and hexamethyldisilazane an then is treated with silicone oil. Such a hydrophobization treatment that silica fine powder is once treated with two or more species of silane compounds and then with silicone oil is preferred because a degree of hydrophobization can be effectively increased.

The above-mentioned hydrophobization treatment (with silane compound(s) and silicone oil) for silica fine powder may be applied to titanium oxide fine powder.

The toner according to the present invention may further contain other external additives, as desired, in addition to silica fine powder and titanium oxide fine powder.

Examples of such external additives may include: resinous fine particles and inorganic fine particles functioning as a charging aid, a conductivity-imparting agent, a flowability-improving agent, an anti-caking agent, a release agent at the time of hot roller fixation, a lubricant, and an abrasive.

The resinous fine particles may preferably have an average particle size of 0.03–1.0 μm.

Examples of a monomer for providing a resin of the resinous fine particles may include: styrene; styrene derivatives, such as o-methylstyrene, m-methylstyrene, p-methylstyrene, p-methoxystyrene, and p-ethylstyrene; methacrylic acid; acrylic acid; methacrylates, such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates, such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate, and phenyl acrylate; acrylonitrile; methacryronitrile; and acrylamide. These vinyl monomers may be used singly or in combination of two or more species.

The above monomer(s) may be polymerized through, e.g., suspension polymerization, emulsion polymerization or soap-free polymerization, preferably soap-free polymerization.

Examples of other fine particles may include: those of lubricants, such as polytetrafloroethylene (teflon), zinc stearate, polyvinylidene fluoride (of which polyvinylidene fluoride is preferred); those of abrasives, such as cerium oxide, silicon carbide, strontium titanate (of which strontium titanate is preferred); those of flowability-improving agents, such as titanium oxide and aluminum oxide (of which hydrophobic fine particles thereof are particularly preferred); those of anti-caking agents; and those of conductivity-imparting agents, such as carbon black, zinc oxide, antimony oxide, and tin oxide.

Further, it is also possible to use a small amount of white or black fine particles having a polarity opposite to that of the toner, as a developing characteristic-improving agent.

The above-described fine particles (including the resinous fine particles, inorganic fine particles, and hydrophobic inorganic fine particles) to be blended with the toner may preferably be used in an amount of 0.1–5 wt. parts, more preferably 0.1–3 wt. parts per 100 wt. parts of the toner.

The toner of the present invention may preferably have a weight-average particle size (D4) of 2.5–10 μm, thus exhibiting its performances sufficiently.

The particle size distribution and weight-average particle size (D4) may be measured according to the Coulter counter method, e.g., by using Coulter Multisizer (=trade name, available from Coulter Electronics Inc.).

In the measurement, a 1%-NaCl aqueous solution may be prepared by using a reagent-grade sodium chloride as an electrolytic solution. It is also possible to use ISOTON R-II (available from Coulter Scientific Japan K.K.). Into 100 to 150 ml of the electrolytic solution, 0.1 to 5 ml of a surfactant, preferably an alkylbenzenesulfonic acid salt, is added as a dispersant, and 2 to 20 mg of a sample is added thereto. The resultant dispersion of the sample in the electrolytic liquid is subjected to a dispersion treatment for about 1–3 minutes by means of an ultrasonic disperser, and then subjected to measurement of particle size distribution in the range of at least 2 μm by using the above-mentioned apparatus with a 100 μm-aperture to obtain a volume-basis distribution and a number-basis distribution. The weight-average particle size ($D_4$) may be obtained from the volume-basis distribution by using a central value as a representative value for each channel.

The following 13 channels are used: 2.00–2.52 μm; 2.52–3.17 μm; 3.17–4.00 μm; 4.00–5.04 μm; 5.04–6.35 μm; 6.35–8.00 μm; 8.00–10.08 μm; 10.08–12.70 μm; 12.70–16.00 μm; 16.00–20.20 μm; 20.20–25.40 μm; 25.40–32.00 μμm; 32.00–40.30 μm. For each channel, a lower limit value is included, and an upper limit value is excluded.

The toner of the present invention may also be used in a two-component developer in combination with a carrier. Examples of the carrier may be known carrier particles of metals, such as surface-oxidized or unoxidized iron, nickel, cobalt, manganese, chromium and rare earth metals; and their alloys and oxides. The carrier particles may preferably have 20–300 μm and be coated with a resinous layer of styrene resin, acrylic resin, silicone resin, fluorine-containing resin or polyester resin.

The toner according to the present invention may preferably be produced through a pulverization process wherein the toner ingredients as mentioned above are sufficiently blended in a blender, such as a ball mill, melt-kneaded by hot kneading means, such as a hot roller, a kneader and an extruder, solidified by cooling, mechanically pulverized by a pulverizer and classified by a classifier to obtain toner particles. However, it also possible to rely on a polymerization toner production process wherein a monomer for constituting a binder resin is mixed with other toner ingredients to form a polymerizable composition, and the composition is subjected to polymerization in an aqueous medium, preferably suspension polymerization; a process for producing a microcapsule toner comprising a core and a shell, at least one of which contains prescribed toner components; and a process for dispersing in a binder resin solution other toner ingredients and spray-drying the resultant mixture. The thus-obtained toner particles may be blended with desired external additives by a blender, such as a Henschel mixer to obtain a toner according to the present invention.

Various machines are commercially available for the above process. Several examples thereof are enumerated below together with the makers thereof. For example, the commercially available blenders may include: Henschel mixer (mfd. by Mitsui Kozan K.K.), Super Mixer (Kawata K.K.), Conical Ribbon Mixer (Ohkawara Seisakusho K.K.); Nautamixer, Turbulizer and Cyclomix (Hosokawa Micron K.K.); Spiral Pin Mixer (Taiheiyo Kiko K.K.), Lodige Mixer (Matsubo Co. Ltd.). The kneaders may include: Buss Cokneader (Buss Co.), TEM Extruder (Toshiba Kikai K.K.), TEX Twin-Screw Kneader (Nippon Seiko K.K.), PCM Kneader (Ikegai Tekko K.K.); Three Roll Mills, Mixing Roll Mill and Kneader (Inoue Seisakusho K.K.), Kneadex (Mitsui Kozan K.K.); MS-Pressure Kneader and Kneadersuder (Moriyama Seisakusho K.K.), and Bambury Mixer (Kobe Seisakusho K.K.). As the pulverizers, Cowter Jet Mill, Micron Jet and Inomizer (Hosokawa Micron K.K.); IDS Mill and PJM Jet Pulverizer (Nippon Pneumatic Kogyo K.K.); Cross Jet Mill (Kurimoto Tekko K.K.), Ulmax (Nisso Engineering K.K.), SK Jet O. Mill (Seishin Kigyo K.K.), Krypron (Kawasaki Jukogyo K.K.), and Turbo Mill (Turbo Kogyo K.K.). As the classifiers, Classiell, Micron Classifier, and Spedic Classifier (Seishin Kigyo K.K.), Turbo Classifier (Nisshin Engineering K.K.); Micron Separator and Turboplex (ATP); Micron Separator and Turboplex (ATP); TSP Separator (Hosokawa Micron K.K.); Elbow Jet (Nittetsu Kogyo K.K.), Dispersion Separator (Nippon Pneumatic Kogyo K.K.), YM Microcut (Yasukwa Shoji K.K.). As the sieving apparatus, Ultrasonic (Koei Sangyo K.K.), Rezona Sieve and Gyrosifter (Tokuju Kosaku K.K.), Ultrasonic System (Dolton K.K.), Sonicreen (Shinto Kogyo K.K.), Turboscreener (Turbo Kogyo K.K.), Microshifter (Makino Sangyo K.K.), and circular vibrating sieves.

Hereinafter, the present invention will be described more specifically based on Examples, which however should not be understood to restrict the scope of the present invention in any way. In the following Examples, "part(s)" means "part(s) by weight".

WAX PRODUCTION EXAMPLE 1

1000 g of a Fischer-Tropsch wax (Mn=718, average carbon number=50.5) as a starting material was placed in a cylindrical reaction vessel of glass and heated up to 120° C. while blowing nitrogen gas into the reaction vessel at a rate of 3 liter/min.

After addition of 26.3 g (0.41 mol) of a mixture of boric acid/boric anhydrides (=1.45 in molar ratio), the system was subjected to reaction at 180° C. for 2.5 hours while blowing thereinto air at a rate of 21 liter/min. and nitrogen gas at a rate of 16 liter/min. in combination.

After the reaction, to the reaction mixture, an equivalent amount of water was added, thus effecting hydrolysis of the reaction mixture. After the hydrolysis, the mixture was leftstanding to recover a waxy component as an upper phase, followed by drying of the waxy component to obtain Wax 1.

Wax 1 showed a hydroxyl value (Hv) of 59.1 mgKOH/g, an ester value (Ev) of 14.2 mgKOH/g, an acid value (Av) of 8.3 mgKOH/g, a melting point (Tmp) of 91° C., a penetration of 6, a viscosity of 12.7 mPa.s, a softening point (Tsp) of 93° C., and Mn of 616.

Synthesis conditions and physical properties of Wax 1 are summarized in Table 1 appearing hereinafter.

WAX PRODUCTION EXAMPLE 2

Wax 2 (Mn=1230) was prepared in the same manner as in Wax Production Example 1 except that 1000 g of polyethylene wax (Mn=1450) was used and the addition amount of boric acid/boric anhydride mixture and the reaction time were changed.

The synthesis conditions and physical properties of Wax 2 are shown in Table 1.

WAX PRODUCTION EXAMPLE 3

Wax 3 (Mn=324) was prepared in the same manner as in Wax Production Example 1 except that 1000 g of paraffin wax (Mn=397) was used and the addition amount of boric acid/boric anhydride mixture was changed.

The synthesis conditions and physical properties of Wax 3 are shown in Table 1.

WAX PRODUCTION EXAMPLE 4

Wax 4 (Mn=373) was prepared in the same manner as in Wax Production Example 1 except that 1000 g of α-olefin wax (Mn=462) was used and the addition amount of boric acid/boric anhydride mixture was changed.

The synthesis conditions and physical properties of Wax 4 are shown in Table 1.

WAX PRODUCTION EXAMPLE 5

Wax 5 (Mn=424) was prepared,in the same manner as in Wax Production Example 1 except that 1000 g of Fischer-Tropsch wax (Mn=502) was used and the addition amount of boric acid/boric anhydride mixture and the reaction time were changed.

The synthesis conditions and physical properties of Wax 5 are shown in Table 1.

WAX PRODUCTION EXAMPLE 6

Wax 6 (Mn=309) was prepared in the same manner as in Wax Production Example 1 except that 1000 g of paraffin wax (Mn=370) was used and the addition amount of boric acid/boric anhydride mixture was changed.

The synthesis conditions and physical properties of Wax 6 are shown in Table 1.

WAX PRODUCTION EXAMPLE 7

Wax 7 (Mn=265) was prepared in the same manner as in Wax Production Example 1 except that 1000 g of paraffin wax (Mn=295) was used and the addition amount of boric acid/boric anhydride mixture and the reaction time were changed.

The synthesis conditions and physical properties of Wax 7 are shown in Table 1.

WAX PRODUCTION EXAMPLE 8

Wax 8 (Mn=738) was prepared in the same manner as in Wax Production Example 1 except that 1000 g of polyethylene wax (Mn=905) was used and the addition amount of boric acid/boric anhydride mixture was changed.

The synthesis conditions and physical properties of Wax 8 are shown in Table 1.

WAX PRODUCTION EXAMPLE 9

Wax 9 (Mn=535) was prepared in the same manner as in Wax Production Example 1 except that 17.1 g (0.39 mol) of metaboric acid was used in place of boric acid/boric anhydride mixture and the reaction time (2.5 hours) was changed to 1.5 hours.

The synthesis conditions and physical properties of Wax 9 are shown in Table 1.

WAX PRODUCTION EXAMPLE 10

Wax 10 (Mn=907) was prepared in the same manner as in Wax Production Example 1 except that 1000 g of polyethylene wax (Mn=1126) was used and the mixing ratio and addition amount of boric acid/boric anhydride mixture were changed.

The synthesis conditions and physical properties of Wax 10 are shown in Table 1.

WAX PRODUCTION EXAMPLE 11

Wax 11 (Mn=524) was prepared in the same manner as in Wax Production Example 1 except that 1000 g of Fischer-Tropsch wax (Mn=615) was used and the addition amount of boric acid/boric anhydride mixture was changed.

The synthesis conditions and physical properties of Wax 11 are shown in Table 1.

Polymer (L1) provided a GPC chromatogram showing a peak molecular weight (Mp) of 15200 and an acid value of 29.6 mgKOH/g. The polymerization composition, peak molecular weight (Mp) and acid value of Polymer (L1) are shown in Table 2 together with those of polymers obtained in the following Polymer Production Examples.

Polymer Production Examples 2–6

Polymers (L2)–(L5) and (H4) of low molecular weight were prepared in the same manner as in Polymer Production Example 1 except. for changing polymerization compositions (respective monomer amounts and initiator amounts and addition of divinylbenzene as desired) as shown in Table 2.

Polymer Production Example 7

Into a four-necked flask, 180 parts of deaerated water and 20 parts of 2 wt. %-polyvinyl alcohol aqueous solution were placed, and a liquid mixture of 70.9 parts of styrene, 25 parts of n-butyl acrylate, 4.1 parts of monobutyl maleate and 0.18 part of 2,2-bis(4,4-di-tert-butylperoxycyclohexyl) propane, was added thereto, followed by stirring to form a suspension liquid. After the interior of the flask was sufficiently aerated with nitrogen, the system was heated to 90° C. to initiate the polymerization. The system was held at that temperature for 24 hours to complete the polymerization. The polymerizate was filtered out, washed with water and dried to obtain

TABLE 1

| | Wax synthesis conditions | | | Wax Properties | | | | | | |
|---|---|---|---|---|---|---|---|---|---|---|
| Wax No. | Boric compound *1 | Amount (mol) | Reaction time (hr) | Hv (mgKOH/g) | Ev (mgKOH/g) | Av (mgKOH/g) | Tmp (° C.) | Penetration | Viscosity (mPa · s) (120° C.) | Tsp (° C.) |
| 1 | BA/BAA = 1.45 | 0.41 | 2.5 | 59.1 | 14.2 | 8.3 | 91 | 6 | 12.7 | 93 |
| 2 | " | 0.42 | 1.0 | 21.7 | 3.9 | 7.0 | 122 | 3 | 16.3 (140° C.) | 125 |
| 3 | " | 1.12 | 2.5 | 133.5 | 39.2 | 23.3 | 75 | 11 | 12.0 | 80 |
| 4 | " | 0.72 | 2.5 | 89.8 | 3.6 | 7.1 | 69 | 24 | 10.9 | 75 |
| 5 | " | 0.44 | 2.0 | 50.5 | 6.7 | 4.4 | 77 | 8 | 11.8 | 83 |
| 6 | " | 0.70 | 2.5 | 80.0 | 18.0 | 12.0 | 73 | 9 | 11.8 | 79 |
| 7 | " | 0.11 | 0.5 | 2.4 | 6.9 | 5.2 | 65 | 2 | 9.5 | 66 |
| 8 | " | 1.56 | 2.5 | 164.8 | 59.0 | 36.2 | 98 | 19 | 17.5 | 106 |
| 9 | MBA | 0.39 | 1.5 | 24.3 | 32.1 | 37.2 | 92 | 11 | 11.6 | 95 |
| 10 | BA/BAA = 1.40 | 0.33 | 2.5 | 33.1 | 8.3 | 4.4 | 101 | 5 | 15.2 | 103 |
| 11 | " | 0.67 | 2.5 | 67.5 | 7.2 | 8.8 | 82 | 6 | 11.2 | 86 |
| 12 *2 | — | — | — | 9.6 | 29.4 | 11.7 | 66 | 12 | 9.7 | 68 |

*1 BA: boric acid, BAA: boric acid anhydride, MBA: metaboric acid.
*2 Wax 12 is a partially esterified product of polyglycerin used in Comparative Examples 4 and 6 appearing hereinafter.

Binder resins were prepared in the following manner.

Polymer Production Example 1

300 parts of xylene was placed in a four-necked flask, and the interior of the flask was sufficiently aerated with nitrogen under stirring. Then, the xylene was heated and subjected to refluxing. Under the reflux condition, a liquid mixture of 69.0 parts of styrene, 22 parts of n-butyl acrylate, 9.0 parts of monobutyl maleate and 1.8 parts of di-tert-butyl peroxide was added dropwise in 4 hours and held for 2 hours for completing the polymerization, followed by removal of the solvent to obtain Polymer (L1) of a low-molecular weight.

Polymer (H1) of high molecular weight. Polymer (H1) provided a GPC chromatogram showing Mp.=$8.2\times10^5$ and exhibited an acid value of 5.3 mgKOH/g.

Polymer Production Examples 8 and 9

Polymers (H2) and (H3) of high molecular weight were prepared in the same manner as in Polymer Production Example 7 except for changing polymerization compositions (respective monomer amounts and initiator amounts and addition of divinylbenzene as desired) as shown in Table 2.

TABLE 2

| Polymers | | | | | | | | |
|---|---|---|---|---|---|---|---|---|
| | Polymerization composition* (wt. parts) | | | | | | | |
| | Monomers | | | Initiators and DVB | | | | Acid value |
| Polymer | MBM | Sty | nBA | DTBP | DVB | BBCP | Mp | (mgKOH/g) |
| L1 | 9.0 | 69 | 22 | 1.8 | — | — | 15200 | 29.6 |
| L2 | 0.2 | 79.8 | 20 | 2.1 | — | — | 10000 | 0.4 |
| L3 | 15.8 | 62.2 | 22 | 1.4 | — | — | 23000 | 51.4 |
| L4 | 1.3 | 78.7 | 20 | 2.6 | — | — | 6800 | 4.1 |
| L5 | 7.7 | 71.3 | 21 | 0.5 | 0.1 | — | 71000 | 25.1 |
| H1 | 4.1 | 70.9 | 25 | — | — | 0.18 | 820000 | 5.3 |
| H2 | 5.2 | 68.8 | 26 | — | — | 0.23 | 540000 | 6.8 |
| H3 | — | 74 | 26 | — | — | 0.19 | 790000 | 0.0 |
| H4 | 2.5 | 72.5 | 25 | 0.5 | 0.14 | — | 160000 | 3.1 |

*MBM = monobutyl maleate,
Sty = styrene,
nBA = n-butyl acrylate,
DTBP = di-t-butyl peroxide,
DVB = divinylbenzene,
BBCP = 2,2-bis(4,4-di-t-butylperoxycyclohexyl)propane.

Binder Production Example 1

Polymer (L1) and Polymer (H1) were blended in solvent xylene and the solvent was removed to obtain Binder resin 1.

Binder Production Examples 2–6

Binder resins 2–6were prepared in the same manner as in Binder Production Example 1 except for changing the species of Polymers to be blended as shown in Table 2.

The molecular weight distribution and acid values of the thus-prepared binder resins are also shown in Table 3.

TABLE 3

| Binder resin | | | | | | | |
|---|---|---|---|---|---|---|---|
| Binder resin No. | Polymers (7:3) | | Mp (main peak) | Mp (sub-peak) | Mw * | Mn | Acid value (mgKOH/g) |
| 1 | L1 | H1 | 15,100 | 790,000 | 361,000 | 8,100 | 22.4 |
| 2 | L2 | H2 | 9,900 | 530,000 | 272,000 | 5,700 | 2.3 |
| 3 | L3 | H1 | 22,800 | 800,000 | 383,000 | 10,300 | 37.6 |
| 4 | L4 | H2 | 6,800 | 540,000 | 251,000 | 3,900 | 4.9 |
| 5 | L2 | H3 | 10,000 | 780,000 | 354,000 | 6,000 | 0.2 |
| 6 | L1 | H4 | 15,000 | 155,000 | 82,000 | 7,200 | 21.7 |

* Mw: weigt"

Example 1

| | |
|---|---|
| Binder resin 1 | 100 parts |
| Magnetic iron oxide | 100 parts |
| Monoazo iron complex | 2 parts |
| Wax 1 | 4 parts |

The above ingredients were melt-kneaded by means of a twin-screw extruder heated at 130° C. After cooling, the kneaded product was coarsely crushed by a hammer mill and then finely pulverized by a jet mill. The pulverizate was classified by a fixed wall-type pneumatic classifier to obtain classified powder, which was further subjected to strict classification by means of a multi-division classifier ("Elbow Jet", made by Nittetsu Kogyo K.K.) utilizing the Coanda effect for removal of fine powder fraction and coarse powder fraction to obtain a negatively chargeable magnetic toner having a weight-average particle size (D4) of 6.8 μm.

The thus-prepared magnetic toner in 100 wt. parts was blended with 1.2 wt. parts of hydrophobic silica fine powder by means of a Henschel mixer to obtain a Developer 1. Physical properties of Developer 1 thus obtained are shown in Table 4 together with those of toners prepared in other Examples and Comparative Examples described hereinafter.

Examples 2–13, Comparative Examples 1–3 and 5 and Reference Example

Developers 2–16, 18 and 20 were prepared in the same manner as in Example 1 except that Wax 1 was changed to Waxes 2–11 and/or Binder resin 1 was changed to Binder resins 2–6 or Polymer (L5) as shown in Table 4, respectively.

Physical properties of the developers are also shown in Table 4.

Comparative Examples 4 and 6

Developers 17 and 19 were prepared in the same manner as in Example 1 and Comparative Example 5, respectively, except for changing Wax 1 to Wax 12 (partially esterified product of polyglycerin; Tmp=66° C., penetration=12, and Mn=381).

Physical properties of the developers are also shown in Table 4.

TABLE 4

| Toner Prescription and Properties | | | | | | |
|---|---|---|---|---|---|---|
| | | Toner prescription | | GPC peak molecular weight ($\times 10^3$) | | Acid value |
| Example No. | Developer No. | Binder resin No. | Wax No. | Lower MW peak | Higher MW peak | of toner (mgKOH/g) |
| 1 | 1 | 1 | 1 | 14.8 | 666 | 12.2 |
| 2 | 2 | 1 | 2 | 14.9 | 675 | 12.4 |
| 3 | 3 | 1 | 3 | 14.8 | 680 | 12.6 |
| 4 | 4 | 1 | 4 | 14.8 | 662 | 11.9 |
| 5 | 5 | 1 | 5 | 14.9 | 671 | 12.4 |
| 6 | 6 | 1 | 6 | 14.9 | 668 | 12.1 |
| 7 | 7 | 2 | 1 | 9.8 | 445 | 1.0 |
| 8 | 8 | 3 | 1 | 21.8 | 669 | 18.2 |
| 9 | 9 | 4 | 1 | 6.9 | 451 | 2.1 |
| 10 | 10 | 5 | 1 | 14.8 | 668 | 0.1 |
| 11 | 11 | 6 | 1 | 9.9 | 142 | 11.8 |
| 12 | 12 | 1 | 10 | 14.8 | 672 | 12.3 |
| 13 | 13 | 1 | 11 | 14.9 | 676 | 12.5 |
| Comp. 1 | 14 | 1 | 7 | 14.9 | 670 | 12.4 |
| Comp. 2 | 15 | 1 | 8 | 14.8 | 661 | 12.1 |
| Comp. 3 | 16 | 1 | 9 | 14.9 | 668 | 12.3 |
| Comp. 4 | 17 | 1 | 12 | 14.7 | 672 | 12.0 |
| Comp. 5 | 18 | (L5) | 7 | 68 | — | 13.1 |
| Comp. 6 | 19 | (L5) | 12 | 69 | — | 13.0 |
| Ref. Ex. | 20 | (L5) | 4 | 68 | — | 13.2 |

The thus-prepared Developers 1–20 were evaluated in the following manner and the evaluation results are shown in Table 5

(Image forming test)

A commercially available laser beam printer ("LBP-3260", made by Canon K.K.) was remodeled so as to increase the paper feed rate of 32 A4-size lateral sheets/min. to a paper feed rate of 50 A4-size lateral sheets/min. by increasing the process speed to 200 mm/sec. and provide fixing conditions of a total pressure of 333 N (34 kgf) and a nip of 9 mm between the heating roller and the pressure roller in the fixing device. Each of the above-prepared developers was charged in a process cartridge for the above-remodeled laser beam printer.

By using the above-remodeled laser beam printer, each developer was subjected to continuous image forming tests on 20,000 sheets in normal temperature/normal humidity (NT/NH) environment (23° C./60% RH), a high temperature/high humidity (HT/HH) environment (32.5° C./80% RH) and a low temperature/low humidity (LT/LH) environment (15° C./10% RH). The images thus formed were evaluated with respect to the following items.

(1) Image Density (I.D.)

Images were continuously printed on 20,000 sheets of plain paper (75 g/m$^2$) for copying, and image densities were measured at the initial stage and the final stage of the continuous printing operation in terms of a relative density compared with that of a white background portion corresponding to an original image density of 0.00 by using a Macbeth densitometer (available from Macbeth Co.).

(2) Fog

Images were continuously printed on 20,000 sheets of plain paper (75 g/m$^2$) for copying, and fog was evaluated at the final stage of the continuous printing operation by measuring a whiteness of the plain paper after printing and a whiteness of a printed solid white image portion on the plain paper respectively by using a reflectometer (available from Tokyo Denshoku K.K.). The difference in whiteness represents a fog. A smaller fog value represents less fog.

(3) Toner (Developer) Sticking

Images were continuously printed on 15000 sheets of plain paper in the high temperature/high humidity environment. The pressure roller surface (in the fixing device) after the continuous printing was observed with eyes with respect to toner melt-sticking onto the fixing device, and the effect thereof on the resultant images formed in the final stage was also evaluated. The evaluation was performed according to the following standard.

A: No toner melt-sticking observed on the pressure roller.

B: Slight toner melt-sticking is observed, but the images are not affected thereby.

C: One or two black spots are observed in the resultant images.

D: Three or more black spots are observed in the resultant images.

(4) Fixing Performance ($T_{F1}$ and $T_{offset}$)

The hot pressure fixation device of the above-mentioned laser beam printer was remodeled so as to allow a heating roller surface temperature setting in a range of 120° C.–250° C. Image formation was formed while changing the roller surface temperature in the range by an increment of 5° C. each in the normal temperature/normal humidity environment.

(Low Temperature Fixability-$T_{FI}$ (° C.)

Printing was performed on plain paper of 90 g/m$^2$ giving a hard fixing condition. The resultant printed image was rubbed with soft tissue paper (lens cleaning paper) under a load of 50 g/cm$^2$. A minimum temperature giving an image density lowering of 10% or less due to rubbing compared with that before rubbing was recorded as a fixing initiation temperature ($T_{FI}$ (° C.)).

(Anti-high Temperature Offset Property—$T_{offset}$ (° C.))

A sample image having an areal image percentage of ca. 5% was printed out on plain paper of 60 g/m$^2$ liable to cause offset and fixed at various temperatures so as to observe the state of soiling of the printed images. A maximum temperature at which the images were free from soiling due to offset was determined as a high-temperature offset-free temperature ($T_{offset}$ (° C.)).

(Anti-blocking Test)

Ca. 10 g of each developer was placed in a 100 cc-plastic cup and left standing for 3 days at 50° C. to evaluate a state of agglomeration by eyes thereof according to the following standard.

A: No agglomerate is observed.

B: Agglomerate is observed but collapsed easily.

C: Agglomerate is observed but collapsed by shaking the cup.

D: Agglomerate can be taken and is not readily collapsed.

The evaluation results are shown in Table 5.

TABLE 5

| Example | Fixation | | Image density | | | | | | Fog | | | | | |
|---|---|---|---|---|---|---|---|---|---|---|---|---|---|---|
| | $T_{FI}$ | $T_{offset}$ | (NT/NH) | | (HT/HH) | | (LT/LH) | | (NT/NH) | | (LT/LH) | | | Anti— |
| No. | (° C.) | (° C.) | initial | final | initial | final | initial | final | initial | final | initial | final | Sticking | Blpcking |
| 1 | 150 | 235 | 1.40 | 1.41 | 1.41 | 1.39 | 1.42 | 1.40 | 1.3 | 1.7 | 1.9 | 2.1 | A | A |
| 2 | 155 | 230 | 1.37 | 1.34 | 1.39 | 1.32 | 1.38 | 1.34 | 2.1 | 2.6 | 2.6 | 3.3 | B | B |
| 3 | 150 | 230 | 1.36 | 1.33 | 1.35 | 1.30 | 1.37 | 1.32 | 2.2 | 2.7 | 2.8 | 3.3 | B | C |
| 4 | 150 | 230 | 1.34 | 1.32 | 1.34 | 1.29 | 1.33 | 1.31 | 2.6 | 2.9 | 3.0 | 3.5 | B | C |
| 5 | 145 | 230 | 1.40 | 1.38 | 1.40 | 1.37 | 1.41 | 1.39 | 1.8 | 2.1 | 2.1 | 2.5 | A | A |
| 6 | 150 | 230 | 1.36 | 1.32 | 1.36 | 1.31 | 1.37 | 1.33 | 2.3 | 2.6 | 2.8 | 3.2 | B | C |
| 7 | 145 | 230 | 1.37 | 1.35 | 1.37 | 1.35 | 1.38 | 1.35 | 2.2 | 2.8 | 2.8 | 3.1 | A | B |
| 8 | 155 | 235 | 1.40 | 1.39 | 1.40 | 1.38 | 1.41 | 1.38 | 1.8 | 1.9 | 2.2 | 2.4 | A | A |
| 9 | 145 | 230 | 1.37 | 1.38 | 1.38 | 1.36 | 1.39 | 1.37 | 2.4 | 2.8 | 2.7 | 3.0 | A | B |
| 10 | 150 | 235 | 1.36 | 1.31 | 1.35 | 1.30 | 1.37 | 1.32 | 2.0 | 2.5 | 2.8 | 3.1 | A | B |
| 11 | 145 | 225 | 1.41 | 1.38 | 1.38 | 1.36 | 1.40 | 1.36 | 2.1 | 2.6 | 2.5 | 2.7 | A | B |
| 12 | 150 | 235 | 1.40 | 1.41 | 1.38 | 1.41 | 1.41 | 1.42 | 1.1 | 1.4 | 1.8 | 1.9 | A | A |
| 13 | 150 | 235 | 1.41 | 1.40 | 1.37 | 1.42 | 1.40 | 1.40 | 1.0 | 1.3 | 1.6 | 1.8 | A | A |
| Comp. 1 | 150 | 215 | 1.37 | 1.37 | 1.38 | 1.36 | 1.39 | 1.36 | 1.9 | 2.2 | 2.3 | 2.6 | D | C |
| Comp. 2 | 150 | 230 | 1.26 | 1.25 | 1.26 | 1.25 | 1.27 | 1.25 | 2.8 | 3.1 | 3.2 | 3.6 | B | D |
| Comp. 3 | 150 | 230 | 1.31 | 1.30 | 1.31 | 1.29 | 1.32 | 1.30 | 2.3 | 2.9 | 2.9 | 3.3 | D | C |
| Comp. 4 | 155 | 215 | 1.32 | 1.33 | 1.32 | 1.29 | 1.34 | 1.31 | 2.4 | 2.8 | 2.7 | 3.0 | D | D |
| Comp. 5 | 160 | 210 | 1.26 | 1.20 | 1.23 | 1.19 | 1.25 | 1.20 | 3.1 | 3.6 | 3.5 | 4.1 | D | C |
| Comp. 6 | 165 | 205 | 1.22 | 1.18 | 1.20 | 1.15 | 1.23 | 1.19 | 3.3 | 3.8 | 3.7 | 4.3 | D | D |
| Ref. | 155 | 220 | 1.27 | 1.28 | 1.27 | 1.24 | 1.28 | 1.26 | 2.8 | 3.4 | 3.3 | 3.8 | C | C |

As described hereinabove, according to the present invention, it is possible to provide a toner which shows higher performances including a low-temperature fixability and anti-high-temperature offset characteristic in combination while retaining a good developing performance even in a severe environmental condition such as a high-temperature/high-humidity environment or low-temperature/low-humidity environment. The toner is also excellent in anti-blocking characteristic and is not readily attached to the fixing member.

What is claimed is:

1. A toner, comprising at least a binder resin, a colorant and a hydrocarbon wax, wherein the hydrocarbon wax has a hydroxyl value (Hv) of 5–150 mgKOH/g and an ester value (Ev) of 1–50 mgKOH/g satisfying Hv>Ev, and the toner has a tetrahydrofuran-soluble content providing a gel-permeation chromatogram showing at least one peak in a molecular weight region of $3\times10^3$ to $5\times10^4$ and at least one peak or shoulder in a molecular weight region of $1\times10^5$ to $1\times10^7$.

2. The toner according to claim 1, wherein the hydrocarbon wax has an acid value (Av) of 1–30 mgKOH/g.

3. The toner according to claim 1, wherein the toner has a tetrahydrofuran-soluble content providing a gel-permeation chromatogram showing at least one peak in a molecular weight region of $3\times10^3$ to $3\times10^4$ and at least one peak or shoulder in a molecular weight region of $1\times10^5$ to $5\times10^6$.

4. The toner according to claim 1, wherein the hydrocarbon wax has a hydroxyl value (Hv) and an acid value (Av) satisfying Hv>Av.

5. The toner according to claim 1, wherein the hydrocarbon wax has a melting point of 65–130° C.

6. The toner according to claim 1, wherein the hydrocarbon wax is a wax obtained by converting an aliphatic hydrocarbon wax into alcohol.

7. The toner according to claim 1, wherein the toner has an acid value of 0.5–100 mgKOH/g.

8. The toner according to claim 1, wherein the hydrocarbon wax has an ester value (Ev) of 1–15 mgKOH/g.

9. The toner according to claim 1, wherein the hydrocarbon wax has an acid value (Av) of 1–10 mgKOH/g.

10. The toner according to claim 1, wherein the hydrocarbon wax has a hydroxyl value (Hv) of 10–100 mgKOH/g, an ester value (Ev) of 1–30 mgKOH/g, and an acid value (Av) of 1–15 mgKOH/g.

11. The toner according to claim 10, wherein the hydrocarbon wax satisfies the following conditions: Hv>2×Ev and Hv>Av.

12. The toner according to claim 10, wherein the hydrocarbon wax satisfies the following conditions: Hv>2×Ev and Hv>2×Av.

13. The toner according to claim 1, wherein the hydrocarbon wax has a hydroxyl value (Hv) of 20–90 mgKOH/g, an ester value (Ev) of 1–20 mgKOH/g, and an acid value (Av) of 1–10 mgKOH/g.

14. The toner according to claim 1, wherein the hydrocarbon wax has a melting point of 70–125° C.

15. The toner according to claim 1, wherein the hydrocarbon wax has a melting point of 75–120° C.

16. The toner according to claim 1, wherein the hydrocarbon wax has a penetration of at most 15.

17. The toner according to claim 1, wherein the hydrocarbon wax has a viscosity at 120° C. of 500 mPa.s.

18. The toner according to claim 1, wherein the hydrocarbon wax has a softening point of 65–140° C.

19. The toner according to claim 1, wherein the hydrocarbon wax contains a component having partial structures represented by the following formulas (A) and (B):

(A)

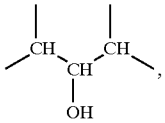

and (B)

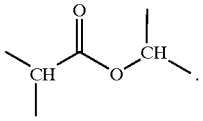

20. The toner according to claim 19, wherein the hydrocarbon wax contains a component having partial structures represented by the following formulas (C) and (D):

(C)

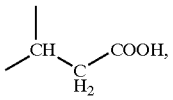

and (D)

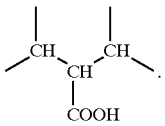

21. The toner according to claim 19, wherein the hydrocarbon wax contains a component having a partial structure represented by the following formula (E):

(E)

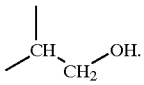

22. The toner according to claim 1, wherein the binder resin has an acid value of 1–100 mgKOH/g.

23. The toner according to claim 1, wherein the binder resin has an acid value of 1–70 mgKOH/g.

24. The toner according to claim 1, wherein the binder resin has an acid value of 1–50 mgKOH/g.

25. The toner according to claim 1, wherein the toner has an acid value of 0.5–50 mgKOH/g.

26. The toner according to claim 1, wherein the toner has an acid value of 1.0–40 mgKOH/g.

27. The toner according to claim 1, wherein the binder resin has a glass transition temperature (Tg) of 45–80° C.

28. The toner according to claim 1, wherein the binder resin comprises a styrene-acrylate copolymer.

29. The toner according to claim 1, wherein the binder resin comprises a styrene-methacrylate copolymer.

30. The toner according to claim 1, wherein the binder resin comprises a polyester resin.

31. The toner according to claim 1, wherein the toner comprises the hydrocarbon wax in an amount of 0.2–20 wt. parts per 100 wt. parts of the binder resin.

32. The toner according to claim 1, wherein the toner comprises the hydrocarbon wax in an amount of 0.5–15 wt. parts per 100 wt. parts of the binder resin.

33. The toner according to claim 1, wherein the toner comprises the hydrocarbon wax in an amount of 1–15 wt. parts per 100 wt. parts of the binder resin.

* * * * *